US009217317B2

(12) United States Patent
Backes

(10) Patent No.: US 9,217,317 B2
(45) Date of Patent: Dec. 22, 2015

(54) SUBSEA COLLECTION AND CONTAINMENT SYSTEM FOR HYDROCARBON EMISSIONS

(71) Applicant: Raymond Michael Backes, Littleton, CO (US)

(72) Inventor: Raymond Michael Backes, Littleton, CO (US)

( * ) Notice: Subject to any disclaimer, the term of this patent is extended or adjusted under 35 U.S.C. 154(b) by 164 days.

(21) Appl. No.: 13/766,655

(22) Filed: Feb. 13, 2013

(65) Prior Publication Data

US 2013/0199792 A1 Aug. 8, 2013

Related U.S. Application Data

(63) Continuation-in-part of application No. 12/853,296, filed on Aug. 10, 2010, now abandoned.

(51) Int. Cl.

| | |
|---|---|
| ***E21B 7/12*** | (2006.01) |
| ***E21B 43/01*** | (2006.01) |
| ***E02B 15/04*** | (2006.01) |
| ***B63B 35/32*** | (2006.01) |
| ***E21B 41/00*** | (2006.01) |
| ***E21B 43/36*** | (2006.01) |

(52) U.S. Cl.

CPC ..... *E21B 43/0122* (2013.01); *B63B 35/32* (2013.01); *E02B 15/04* (2013.01); *E21B 41/005* (2013.01); *E21B 43/36* (2013.01)

(58) Field of Classification Search

CPC ..... E21B 43/0122; E21B 43/36

USPC ..... 166/357, 363

See application file for complete search history.

(56) References Cited

U.S. PATENT DOCUMENTS

| | | | | |
|---|---|---|---|---|
| 3,674,150 | A * | 7/1972 | Lejeune | 210/245 |
| 4,268,245 | A * | 5/1981 | Straitz, III | 431/202 |
| 4,290,714 | A * | 9/1981 | Strange | 405/60 |
| 4,395,157 | A * | 7/1983 | Cunningham | 405/60 |
| 4,440,523 | A * | 4/1984 | Milgram et al. | 210/170.11 |
| 4,456,071 | A * | 6/1984 | Milgram | 166/356 |
| 5,711,374 | A * | 1/1998 | Kjos | 166/265 |
| 6,276,455 | B1 * | 8/2001 | Gonzalez | 166/357 |
| 7,097,387 | B2 * | 8/2006 | Karayaka et al. | 405/211 |
| 7,785,035 | B2 * | 8/2010 | Jarvinen | 405/60 |

FOREIGN PATENT DOCUMENTS

| | | | | |
|---|---|---|---|---|
| GB | 2071020 | A * | 9/1981 | B63B 35/44 |

* cited by examiner

*Primary Examiner* — Matthew Buck
*Assistant Examiner* — Aaron Lembo
(74) *Attorney, Agent, or Firm* — Jennifer L. Bales; Macheledt Bales LLP

(57) ABSTRACT

A rapidly deployable flexible enclosure system for the collection, containment and presentation of hydrocarbon emissions from compromised shallow or deepwater oil and gas well systems, pipelines, other structures, including subsea fissures. The flexible containment enclosure can accommodate various depths and collection terminator configurations. The flexible containment enclosure system is connected to a floating platform and supported by positive offset neutral buoyancy attachment devices. The floating platform with the flexible containment enclosure separates liquid and gaseous materials and directs them to separate ports for removal from a rigid enclosure cavity integrated within the floating platform. Gaseous emissions may optionally be directed to a tethered floating flare system. The system has the ability to partially or fully submerge for extended durations and resurface on demand manually or by transmitted signal. The system provides for operation by a combined tele-supervisory and autonomous control system.

22 Claims, 34 Drawing Sheets

SUBSEA COLLECTION AND CONTAINMENT SYSTEM FOR HYDROCARBON EMISSIONS

This application is a continuation in part of U.S. patent application Ser. No. 12/853,296, filed Aug. 10, 2010 and incorporates that application by reference.

BACKGROUND OF THE INVENTION

1. Field of the Invention

Embodiments of the present invention relate to rapidly deployable flexible enclosure systems for the collection, containment and presentation of hydrocarbon emissions from compromised shallow or deepwater oil and gas well systems, pipelines, and subsea fissures. In particular, the invention relates to such systems used in conjunction with enclosures connected to floating platforms for separating and routing liquid and gaseous hydrocarbon products captured by the enclosure systems.

2. Discussion of Related Art

Oil leakage and or other environmentally sensitive hydrocarbon emissions originating from varied underwater compromised locations, including natural events, need to be addressed quickly and effectively to minimize damage. The longer the delay to respond and provide effective remediation for these situations, may cause unintended and exponential problems across economic, environmental and societal realms.

Current resources and technologies are limited to one incident at a time within the same response area. This is due to limited availability of an extensive required support infrastructure, the cost, and with few staged deployment locations. There were 1361 offshore projects active in 69 countries, operated by 198 companies as of Jul. 7, 2012.

The Deepwater Horizon oil spill (or BP oil spill) began gushing oil into the Gulf of Mexico on Apr. 20, 2010 after an explosion on the Deepwater Horizon oil rig killing 11 workers. It was not capped until Jul. 15, 2010, after 4.9 million barrels of crude oil were spilled into the Gulf. The economic and environmental devastation caused by this disaster are well known.

Government entities and regulators, as well as oil and gas companies, continue to search for improved methods to address future oil spills. There are a number of small to large scale Oil Spill Response Organizations (OSRO) all with inherent limitations in response times and capabilities.

In February of 2011, A group of oil companies led by Exxon formed a consortium called the Marine Well Containment Company MWCC and announced that they had developed a system that could stop an undersea oil spill in a matter of weeks, rather than the 85 days it took to cap the Deepwater Horizon oil spill. The system is designed to be assembled within two to three weeks after an oil spill begins.

Helix Energy Solutions, which assisted with the Deepwater Horizon oil spill, has developed a Fast Response System for future spills. Helix incorporates a number of deployed and operational resources that will stop work and redirect the vessels and required resources to the spill location.

BP recently constructed their own system weighing some 500 tonnes that requires 35 trailers, seven aircraft (Five Russian Antonov AN-124 and two Boeing 747-200s) to transport from storage to a major airport and then fly to the nearest airport that can handle such aircraft and equipment close to the spill location to start unloading for deployment. BP claims this system can be transported and deployed within ten days.

What is needed is a readily transportable, quickly deployable system to collect and contain hydrocarbon emissions from compromised shallow to ultra-deepwater oil and gas well systems, pipelines, and subsea fissures.

SUMMARY OF THE INVENTION

This summary is provided to introduce a selection of concepts in a simplified form that are further described in the detailed description of the invention and is not intended to limit the scope of the claimed subject matter.

One or more embodiments of the present invention are directed to a transportable, quickly deployable and operable system to collect and contain hydrocarbon emissions from compromised shallow to ultra-deepwater oil and gas well systems, pipelines, structures and subsea fissures.

The objective is to collect, contain and direct the compromised hydrocarbon emissions for proper presentation without requiring the use of dispersants or Hydrate inhibitors and associated support vessels, while significantly reducing the time to deploy and begin operations.

With a rapid deployment and versatile containment strategy provided by this invention commencing within a few days of a compromised emissions notification, other resources can focus on drilling a relief well or establishing other long term solutions including the initial spill remediation.

The system includes a self-supporting flexible containment enclosure (SSFCE) for capturing and containing leaking hydrocarbons and a floating platform, both providing for the separation and routing of liquid and gaseous hydrocarbon products. The separation of the gas, oil and water is performed within the uppermost portion of the SSFCE in conjunction with the floating platform in a controlled process using sensors and instrumentation to monitor and adjust the flow rates. The historical analogy is a "gun barrel separator".

The system does not rely on sump or pumping of the product as a continuous method of removal. The gas is generally flared remotely under its own pressure and flow rate, and the liquid product is presented to the operators under its own pressure and flow rate.

The floating platform is attached to the SSFCE and together they separate liquid and gaseous products. The gaseous product may be burned at the platform or (more often) at a separate station, while the liquid product may be salvaged by a separate vessel via a pipeline. Burning the gaseous product at the floating platform requires a significantly large platform such as a vessel that could incorporate a flare system. Liquid product is generally salvaged by a separate vessel and/or temporarily stowed in floating assemblages awaiting offload or changeouts to a vessel/tanker.

Apparatus for collecting, separating, and delivering a combination of gaseous product and liquid product emitted into a liquid environment beneath the apparatus, includes a separator for separating the gaseous product and liquid product, the separator including a separator enclosure, a liquid product conduit for delivering liquid product to a liquid product destination, a gaseous product conduit for delivering gaseous product to a gaseous product destination, and a diverter within the separator enclosure for diverting gaseous product away from the liquid conduit.

The apparatus also includes a self-supporting flexible containment enclosure (SSFCE) forming a tube having a first end disposed at the source of the gaseous product and liquid product and having a second end disposed at the separator enclosure, such that the gaseous product and liquid product enter the SSFCE first end, rise within the SSFCE, and approach the SSFCE second end adjacent to and beneath the diverter. Note that the separator enclosure may include the top end of the SSFCE, and the diverter may be located partially or fully within the top end of the SSFCE or above it.

The liquid product conduit includes a first end above and adjacent to the diverter to collect the liquid product and above a second end spaced apart from the separator enclosure to deliver the liquid product. The gaseous product conduit includes a first end spaced apart from and above the diverter and the liquid product conduit first end to collect the gaseous product and a second end spaced apart from the separator enclosure to deliver the gaseous product.

As a feature, the apparatus may further include a control mechanism for determining volume of the liquid product and/or the gaseous product within the separator enclosure. The control system changes pressure within the separator enclosure based on the determined volume. For example, pressure within the separator enclosure could be controlled by affecting the flow rates of one or both of the products.

The SSFCE may comprise segments formed as elongated tubes, a loop material flap formed at one end of each segment, and a hook material flap formed at the other end of each segment, wherein the hook material flap on a segment engages with the loop material flap on an adjacent segment, forming a continuous tube, and subsea buoys attached to the segments for creating neutral buoyancy.

The hook flap may formed in an I shape and the loop flap formed in a V shape which is configured to engage both sides of the I shape, or vice versa.

Straps attached along the long sides of segments include connection points configured to allow a strap end to connect to the end of an adjacent strap. This provides structural support for the SSFCE.

A relief port having an opening configured to allow removal of a portion of SSFCE content (e.g. sea water, the combination of gaseous product and liquid product, solid particulates, or some combination of these).

As a feature SSFCE segments may form a Y shape such that one end of the Y allows for a single gaseous product and liquid product flow and the other end of the Y allows for two gaseous product and liquid product flows. In other words, one flow may be divided into two (or more) flows, or two flows may be combined into one flow, as needed.

The SSFCE preferably further included a terminator interface assembly configured to engage a targeted area of emissions. One sort of terminator interface assembly comprises a flaring canopy having a clamping mechanism for clamping the canopy to an underwater surface. This terminator is especially useful for covering extended areas of leakage, for example on the sea floor. Another sort of terminator interface assembly comprises a conduit and apparatus for engaging the conduit to an opening, such as a pipe end or a hole is a pipe or other surface.

As a feature, the gaseous product destination might be a flare platform configured to burn off gaseous product. In addition, the apparatus may further include a floating platform attached to the separator enclosure, the floating platform further including apparatus configured to selectively change platform buoyancy to change draft of the floating platform, partially or fully submerging it when advisable because of turbulence or the like.

The invention for the most part is a passively operated system except for the required flow controls, sensors, buoyancy operation functions and process control systems. Pumps used to manage the compromised emissions products would typically be located aboard Floating Production Storage Offloading (FPSO or FSO) vessels or shuttle tankers for receiving the products.

A method according to the present invention of collecting, separating, and delivering a combination flow of gaseous product and liquid product emitted into a liquid environment, includes the steps of providing a tubular self supporting flexible containment enclosure (SSFCE) having a bottom end disposed at a source of the emitted product flow and a top end above the source of the emitted product flow; allowing the emitted product flow to rise within the SSFCE, separating the gaseous product from the liquid product within a separator attached at the top end of the SSFCE, the separator comprising a diverter within a separator enclosure, presenting the separated gaseous product to a gaseous product destination; and presenting the separated liquid product to a liquid product destination.

The step of separating comprises the steps of introducing a closed concave diverter into the rising product flow, the closed side of the diverter disposed downward toward the emitted flow, diverting the flow around the diverter, allowing the liquid product to sink into the diverter upper open side, and allowing the gaseous product to rise above the diverter.

The method collects the liquid product within the diverter upper open side and passes it through a liquid conduit to the liquid product destination. The method also collects the gaseous product above the diverter and passes it through a gaseous conduit to the gaseous product destination.

The method also determines volume of at least one of either liquid product or gaseous product within the separator enclosure and changes pressure within the separator enclosure based on the determined volume.

The step of providing the SSFCE comprises the steps of forming segments formed as elongated tubes, forming a loop material flap at one end of each segment, forming a hook material flap at the other end of each segment, engaging the hook material flap on a segment with the loop material flap on an adjacent segment, forming a continuous tubular SSFCE, attaching the bottom end of the SSFCE adjacent to the source of the emitted product flow, partially filling the SSFCE with liquid from the liquid environment, and attaching the top end of the SSFCE to the separator.

The step of attaching the bottom end of the SSFCE adjacent to the source of the emitted product flow might comprise the step of providing a flaring canopy and clamping the canopy to an underwater surface or the step of attaching the bottom end of the SSFCE adjacent to the source of the emitted product flow further comprises the step of providing conduit and engaging the conduit to an opening.

The method may also burn off gaseous product at the gaseous product destination.

Those skilled in the art will appreciate that configurations similar to embodiments shown and described herein may be used.

BRIEF DESCRIPTION OF THE DRAWINGS

FIG. 2A is an isometric side view of a solar panel elevated assembly according to the present invention.

FIG. 2B is an isometric side view of a manhole access port.

FIG. 2C is an isometric side view of an ingress bulkhead port and door formed in a side wall of the rigid enclosure for the ingress of water from an external pump.

FIG. 2D is an isometric side view of an outrigger pump assembly connected to the ingress bulkhead port shown in FIG. 2C. The hinged door assembly of FIG. 2C is removed for clarity.

FIG. 3A is a side view of a first embodiment of an SSFCE segment including support straps and strap termination points for connecting segments.

FIG. 3B is a detailed view of one of connected strap termination points of FIG. 3A.

FIG. 3C is a detailed view of connected strap termination points as in FIG. 3A, further including a protruding attachment point for connecting a buoy and/or other lines.

FIG. 3D is a oblique detailed isometric wireframe view of a SSFCE Segment with hidden edges.

FIG. 3E is an oblique detailed hidden isometric view of a second embodiment of an SSFCE segment as in FIG. 3A, further including drag coefficient reduction panels and tail panels.

FIG. 3F is a top view of the segment of FIG. 3E.

FIG. 3G is a top view and variation on the segment of FIG. 3E without the tail panels where the drag coefficient reduction panels are connected using both opposing edges of the SSFCE segment or in some cases opposing edges of two or more SSFCE segments.

FIG. 3H is a side view of the segment of FIG. 3E.

FIGS. 3I-L show isometric views of another embodiment of a SSFCE segment including a relief port.

FIG. 4A is a side view of a hook portion of a first embodiment of the connection, while FIG. 4B is a side view of the loop portion.

FIGS. 4C and 4D (both side views) show a second embodiment of a hook-and-loop connection and FIGS. 4E and 4F (both side views) show a third embodiment of a hook-and-loop connection.

FIG. 5A shows a side view of the deployment. FIG. 5B shows the connection between a Positive Offset Neutral Buoyancy Attachment Device (PONBAD) and a strap termination point.

FIG. 6A is a side view of a first embodiment of a subsea terminator interface.

FIG. 6B is a side view of a terminator lower conduit assembly.

FIG. 6C is a top view of compression and strap plates for connection of frustum panel enclosure section to terminator conduit to complete the assembly as shown in side view FIG. 6A.

FIG. 6D is a side view of a second embodiment of a subsea terminator interface, configured to connect to dual SSFCE segments 300.

FIG. 7A is a side view of the assembly, and FIG. 7B is bottom isometric view of the assembly.

FIG. 8A an isometric view of the floating flare assembly, FIG. 8B is a side view of the floating flare assembly, FIG. 8C is a stern side isometric view of the floating flare assembly, FIG. 8D is a bottom isometric view of the floating flare assembly and FIG. 8E is a detailed hidden isometric view of a thermal block used in the floating flare assembly.

DETAILED DESCRIPTION OF THE INVENTION

Figure 1A:
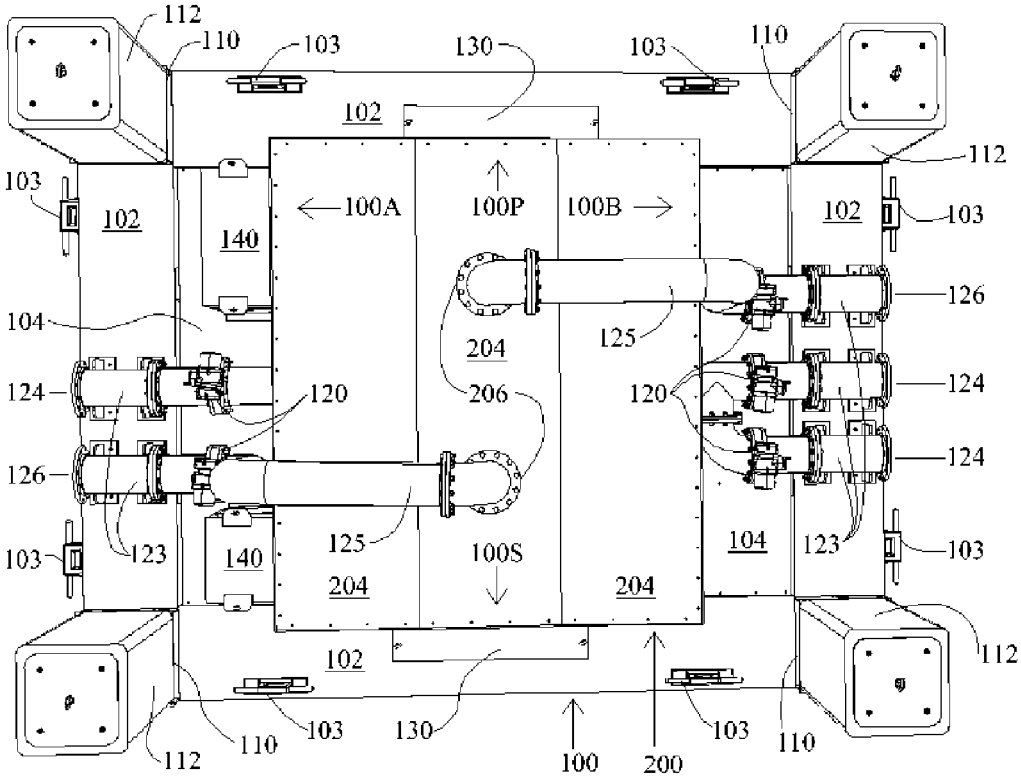
FIG. 1A shows a top view of a floating platform according to the present invention.

The following table lists elements of the illustrated embodiments of the invention and their associated reference numbers for convenience.

| Ref. No. | Element |
|---|---|
| 100 | Floating platform |
| 100A | Aft position (Stern) |
| 100B | Bow position (Fore) |
| 100P | Port position (Left side) |
| 100S | Starboard position (Right side) |
| 101 | Mooring point |
| 102 | Flotation vessel |
| 103 | Cleat |
| 104 | Flotation platform upper deck |
| 105 | Support block |
| 106 | Drilled and Tapped Mounting Block |
| 107 | Drilled and Tapped Solid Vertical and Horizontal Bars |
| 108 | Exterior structural beam assembly |
| 110 | Locator buoy support enclosure |
| 112 | Locator buoy |
| 120 | Valve assembly (121 and 122) |
| 121 | Valve (¼ turn Butterfly Valve) |
| 122 | Electrically controlled valve actuator |
| 123 | Pipe assembly |
| 124 | Liquid product port |
| 125 | Pipe segments |
| 126 | Gaseous product port |
| 127 | Flange |
| 128 | Elbow |
| 129 | Tee |
| 130 | Compressed air tank cascade array enclosure |
| 131 | Compressed air tanks |
| 132 | Regulator |
| 140 | Watertight equipment enclosures |
| 150 | Outrigger pump assembly |
| 151 | Outrigger pump assembly frame |
| 152 | Outrigger pump |
| 154 | Outrigger pump discharge pipe assembly |
| 155 | Outrigger pump discharge port flange |
| 156 | Hydraulic Pump |
| 157 | Hydraulic Motor |
| 158 | Hydraulic Lines (supply, return and drain lines) |
| 159 | Diesel Power Unit |
| 200 | Rigid enclosure |
| 201 | Rigid enclosure wall |
| 202 | Manhole entry w/bolted hatch cover |

-continued

| Ref. No. | Element |
|---|---|
| 203 | Flow pump bulkhead connection w/bolted hatch cover |
| 204 | Rigid enclosure upper deck |
| 205 | Interior instrument sensor watertight enclosure |
| 206 | Gaseous product port connection |
| 208 | Interior structural beam assembly |
| 210 | Lower perimeter mating assembly |
| 220 | Liquid product port bulkhead connection |
| 225 | Lateral conduit |
| 230 | Internal tee |
| 235 | Downward submerged conduit |
| 240 | Bubble diverting assembly |
| 245 | Stays |
| 250 | Elevated solar panel structure |
| 252 | Watertight solar panels with adjustable angle assembly |
| 255 | Navigation lighting aids |
| 260 | Antennas and support structure |
| 265 | Lightning arrester |
| 276 | Outrigger pump discharge external bulkhead port & hinged door |
| 278 | Outrigger pump discharge port internal bulkhead flange |
| 280 | Rigid enclosure bubble diverter |
| 282 | Bubble diverter interior wall |
| 283 | Bubble diverter exterior wall |
| 284 | Bubble diverter upper opening |
| 286 | Bubble diverter closed bottom |
| 288 | Bubble diverter fin standoffs |
| 290 | Bubble diverter fin (paired dashed lines represent front and rear fins/slats) |
| 300 | Self-supporting flexible containment enclosure (SSFCE) segment |
| 300A | Segment with drag coefficient reduction elements (302A, 302B, 308) |
| 300B | SSFCE tee assembly |
| 300C | Canopy Terminator |
| 300D | Segment with relief port |
| 302 | Panel |
| 302A | Leading edge panel |
| 302B | Tail panel |
| 302C | Frustum panel segment |
| 303 | Loop flap (Female Connector or Connection) |
| 303A | Loop Flap Connection Double Flap |
| 303B | Loop Flap Connection Quad Flap |
| 304 | Loop material |
| 305 | Hook flap (Male Connector or Connection) |
| 305A | Hook Flap Single-Hook |
| 305B | Hook Flap Tri-Hook |
| 306 | Hook material |
| 308 | Support strap |
| 310 | Eyelets |
| 312 | Strap termination connection point |
| 314 | Protruding attachment point |
| 330 | Interior membrane |
| 332 | Exterior membrane |
| 344 | Lateral sleeve |
| 345 | Skirt assembly |
| 352 | Switchable Magnet or other clamping device |
| 354 | Weighted anchoring object |
| 370 | One-way Relief port |
| 371 | One-way Relief port assembly upper terminus |
| 372 | One-way Relief port assembly lower terminus |
| 373 | One-way Relief port panel assembly |
| 374 | One-way Relief port panel assembly flanges |
| 375 | One-way Relief port membrane valve assembly |
| 380 | External membrane gasket panel |
| 381 | Internal membrane gasket panel |
| 376 | Slotted semi-flexible plate |
| 377 | Membrane flaps |
| 382 | Flexible membrane material |
| 383 | Flexible membrane material battens |
| 378 | One-way Relief port lower opening |
| 384 | One-way Relief port lower opening exterior seal perimeter connection |
| 379 | One-way Relief port lower opening exterior flap seal |
| 385 | Exterior flap seal perimeter connection |
| 500 | Self-supporting flexible containment enclosure (SSFCE) |
| 502 | Waterline |
| 503 | Seawater |

-continued

| Ref. No. | Element |
|---|---|
| 504 | Seafloor |
| 510 | Mooring lines |
| 516 | Anchorage points |
| 518 | Tethered cable connection lanyard. |
| 520 | Subsea buoy |
| 522 | Eye hook |
| 550 | Targeted area of hydrocarbon emissions (leak source) |
| 564 | Liquid Hydrocarbon Emissions (Liquid Product or Crude Oil) |
| 566 | Gaseous Hydrocarbon Emissions (Gas Product or Methane Gas) |
| 567 | Methane Hydrates (Methane clathrate or Clathrate hydrate) |
| 568 | Reservoir Water |
| 570 | Elevated temperature ascending material |
| 572 | Lower temperature ascending material |
| 574 | Cooler Seawater Descending |
| 576 | Equal interior and exterior pressure. @ 100 feet = 44.5 psi gauge |
| 577 | Equal interior and exterior pressure. @ 2000 feet = 890 psi gauge |
| 578 | Equal interior and exterior pressure. @ 5000 feet = 2225 psi gauge |
| 600 | Subsea terminator interface assembly |
| 600A | Dual subsea terminator interface assembly |
| 604 | Termination Points |
| 605 | Frustum panel enclosure section (302, 308, 310) |
| 606 | Panel terminator plate |
| 607 | Lower conduit section |
| 608 | Handles |
| 609 | Eye Bolts |
| 610 | Tapered pointed set bolts |
| 611 | Bolt strip |
| 612 | Mounting positions |
| 613 | Fasteners for compression straps |
| 614 | Split plates |
| 615 | Compression straps |
| 616 | Connector plate |
| 620 | Guy lines |
| 622 | Guy lines |
| 625 | Terminator section |
| 650 | Combined terminator tee assembly |
| 652 | Horizontal manifold tee section |
| 654 | Valves |
| 656 | Manifold port |
| 658 | Flanged port |
| 700 | Towable Bladder Bag |
| 701 | Flexible Marine Hose |
| 702 | Shuttle Tanker Vessel or other vessel to present the product to |
| 750 | Ancillary Sensors (Sensors including as an example 751-779) |
| 751 | Pulsed radar liquid level sensor |
| 752 | Laser liquid level sensor |
| 753 | Ultrasonic liquid level sensor |
| 754 | Ultrasonic gas flow sensor |
| 765 | Ultasonic liquid flow sensor |
| 766 | Mechanical vane liquid flow sensor |
| 767 | Multi-point liquid level sensor switch |
| 768 | Pressure sensor |
| 769 | Pressure sensor switch |
| 770 | Load Cell sensor (strain gauge) |
| 771 | Tri-axial accelerometer, rate gyro and magnetometer |
| 772 | Thermocouple sensor |
| 773 | Voltage and current sensor |
| 774 | Photoelectric cell sensor |
| 775 | Moisture detection sensor |
| 780 | Ancillary Equipment (For example 781-799) |
| 781 | Batteries |
| 782 | Charge Controller and Regulators |
| 783 | Solid State IGBT Relays |
| 784 | Snubber and Polarity Protection Diodes |
| 785 | Water to Air Heat Exchanger |
| 786 | Water Pump |
| 787 | Solenoid Operated Valve |
| 788 | Video Camera (internal or external) |
| 789 | LED Lighting |
| 790 | Polycarbonate Lexan ™ MR-10 |
| 791 | Digital controlled rotary or linear actuator |
| 794 | Subsea qualified cables, connectors, etc |

-continued

| Ref. No. | Element |
|---|---|
| 796 | Water and Gas (high and low pressure) hoses, bulkhead fittings, etc. |
| 799 | Electronic Modules |
| 800 | Floating flare platform |
| 800A | Aft position (Stern) |
| 800B | Bow position (Fore) |
| 800P | Port position (Left side) |
| 800S | Starboard position (Right side) |
| 801 | Lower horizontal structural beam assembly |
| 802 | Floating flare upper deck |
| 804 | Condensate collection enclosure |
| 805 | Chemical pump (Condensate collection enclosure) |
| 806 | Flashback enclosure - seal enclosure |
| 807 | Water pump (Flashback enclosure) |
| 810 | Vertical corner support assembly |
| 812 | Upper horizontal structural beam assembly |
| 814 | Exterior horizontal single support assembly |
| 816 | Exterior horizontal corner support assembly |
| 820 | Radiant panels |
| 821 | Radiant panel flare flange access plates |
| 822 | Thermal block |
| 824 | Thermal block base material |
| 825 | Countersunk fastener hole for base material |
| 826 | High temperature and high strength bonding material |
| 828 | Thermal block insulator material |
| 829 | Countersunk fastener hole for insulator material |
| 830 | Flare assembly (832, 834, 836} |
| 832 | Barrel |
| 834 | Arms |
| 836 | Orifice |
| 840 | Suspended counterweight |
| 842 | Cables |
| 850 | Process Control System |
| 852 | Flare Ignition Controller System |
| 854 | Flare igniter |
| 856 | Flare ignition fuel |
| 858 | Flare ignition purge gas |
| 902 | Top interior surface of flotation vessel |
| 904 | Bottom interior surface of flotation vessel |
| 906 | Air port via bulkhead |
| 908 | Water port via bulkhead |
| 910 | Air vent outlet |
| 912 | Ballast blow out port and inline check valve |
| 914 | Gross/Fine Filter Water Inlet |
| 918 | Water Pump |
| 920 | Electronic liquid level sensor |
| 921 | Surfacing logic |
| 922 | Compressed air inlet solenoid valve |
| 924 | Water outlet solenoid valve |
| 925 | Submerging logic |
| 926 | Air outlet solenoid valve |
| 928 | Water inlet solenoid valve |
| 935 | Buoyancy control system |
| 950 | Process Control System |
| 951 | Electronic Modules |
| 954 | Floating platform product flow system |
| 958 | External Operators |
| 970 | Fluid Flow In |
| 971 | Desired Liquid Level Reference Set Point SP |
| 972 | Liquid Level Sensors Process Variable PV |
| 973 | Offset (+ or −) |
| 974 | PID Controllers |
| 975 | Manipulated Variable MV |
| 976 | Gas Pressure Inputs Process Variable PV |
| 977 | Fluid Flow Out |
| 980 | Ground Radio Data Link (Digital Link Transceiver and antenna) |
| 982 | External Operator (Local Site Deployment Group) |
| 984 | External Operator (Remote Spill Management and Engineering |
| 986 | Internet Network |
| 988 | Satellite Data Link (Satellite transceiver and antenna) |
| 990 | Satellite Network |

For convenience, in the following description the term "FIG. 1" is used to refer collectively to FIGS. 1A-C. There is no separate FIG. 1 apart from FIGS. 1A-C. Similarly, "FIG. 2" is used to refer collectively to FIGS. 2A-2D, "FIG. 3" is used to refer collectively to FIGS. 3A-3L, "FIG. 4" is used to refer collectively to FIGS. 4A-4F, "FIG. 5" is used to refer collectively to FIGS. 5A-5B, "FIG. 6" is used to refer collectively to FIGS. 6A-6D, "FIG. 7" is used to refer collectively to FIGS. 7A-7C, and "FIG. 8" is used to refer collectively to FIGS. 8A-8E.

Figure 9:
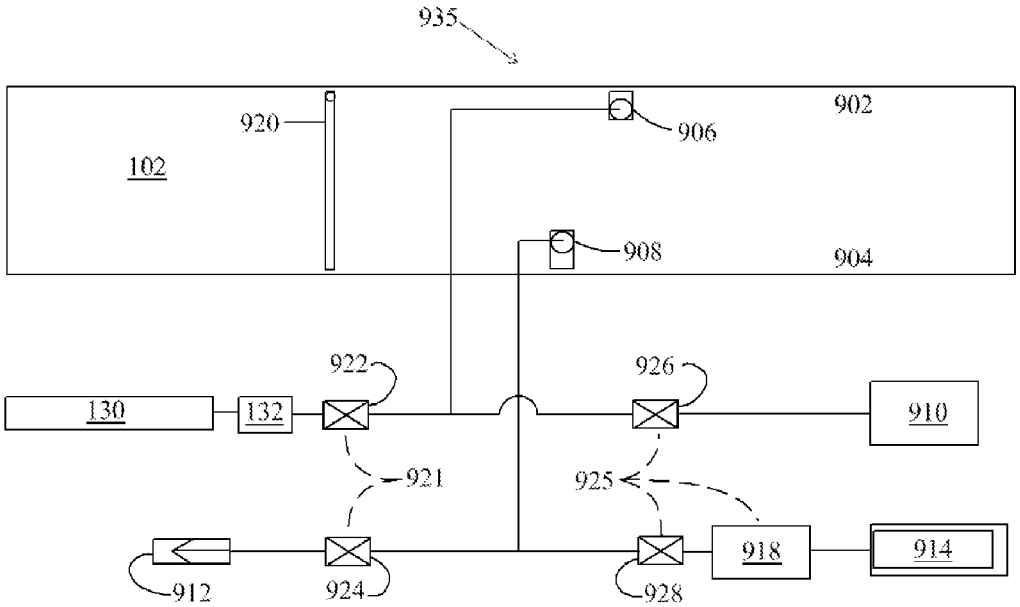
FIG. 9 illustrates buoyancy control logic for the floating platform flotation vessels.
Figure 10:
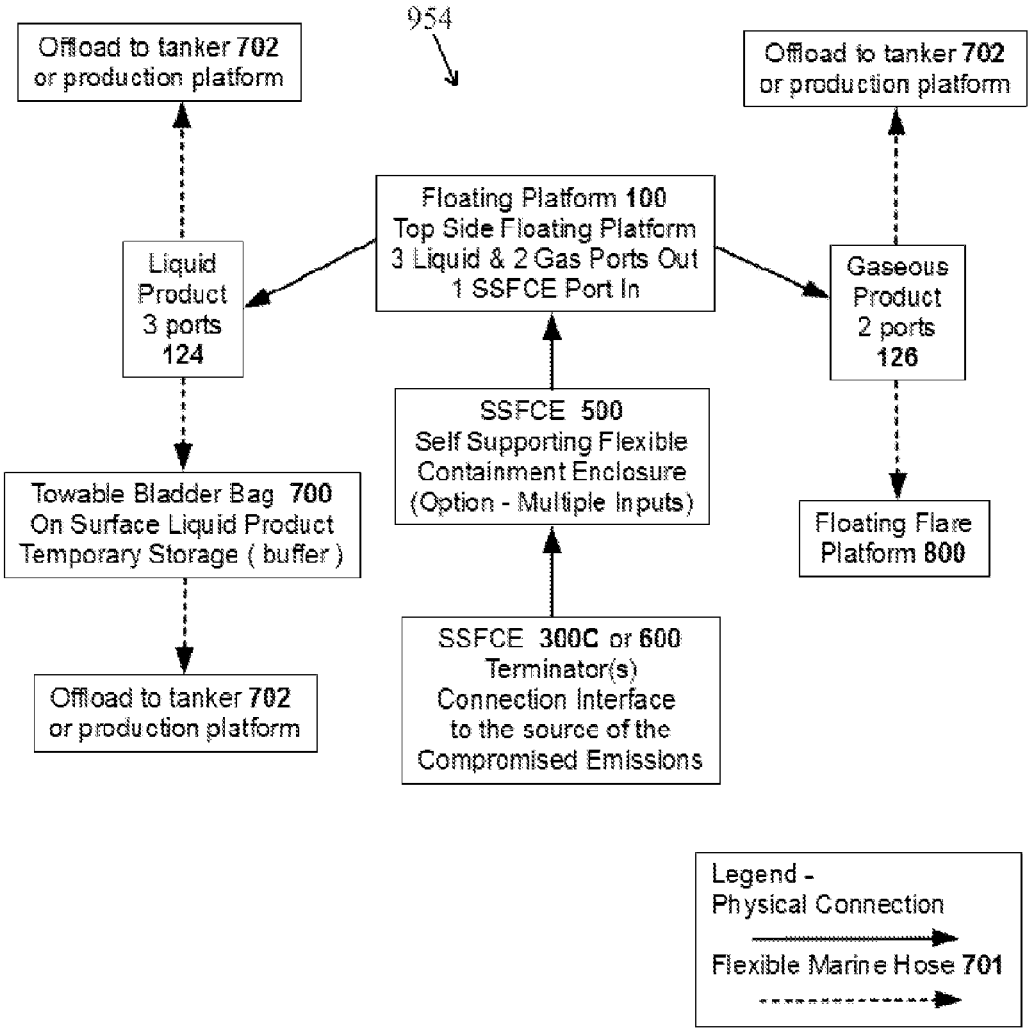
FIG. 10 is a flow chart illustrating product flow from origination to potential destinations.
Figure 11:
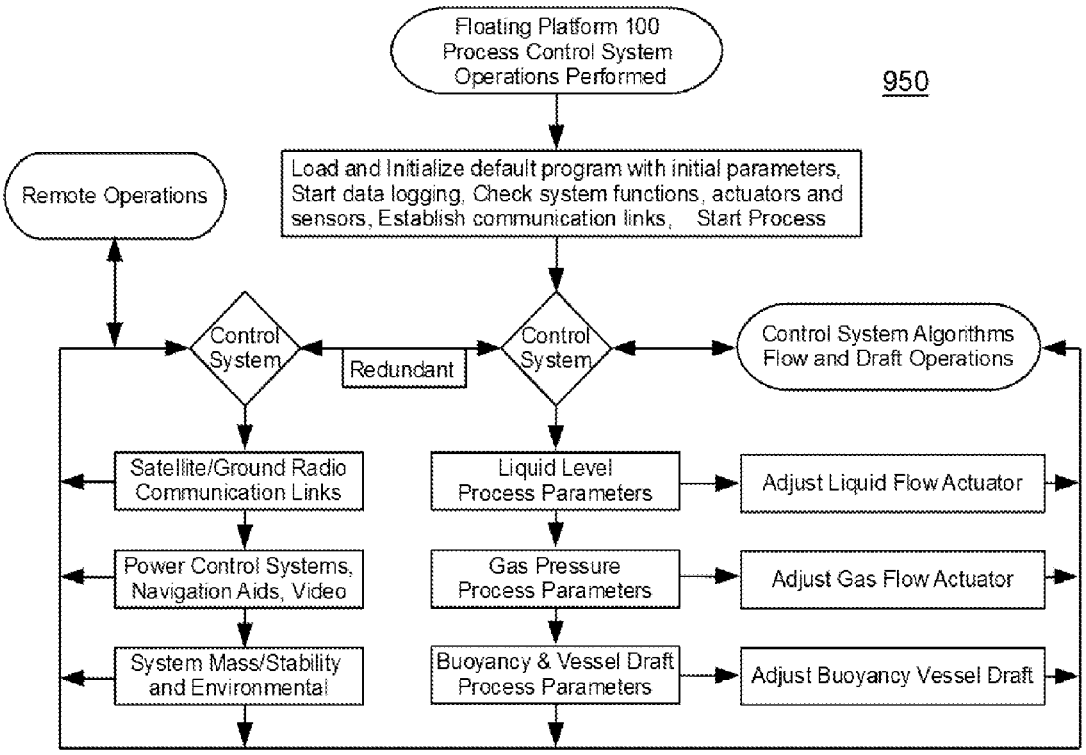
FIG. 11 is a block diagram illustrating a majority of the Process Control System 950 operations performed on the Floating Platform 100
Figure 12:
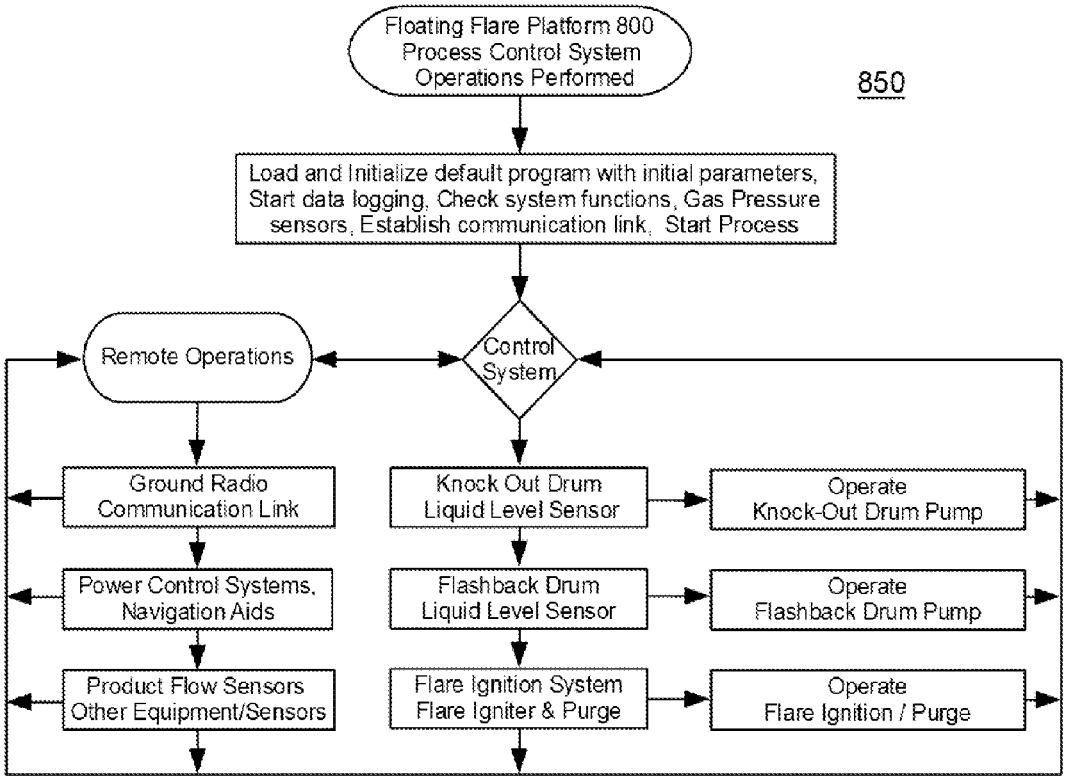
FIG. 12 is a block diagram illustrating a majority of the Process Control System 850 operations performed on the Floating Flare 800.
Figure 13:
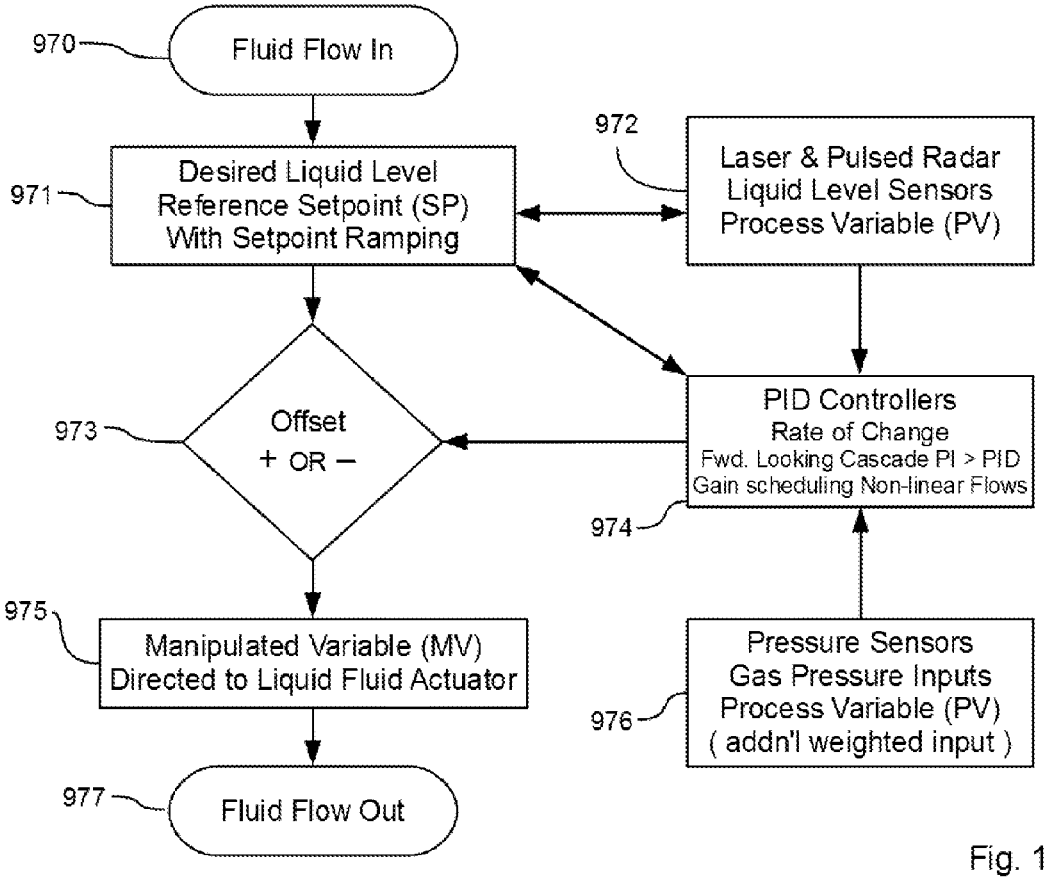
FIG. 13 illustrates an example of the fluid flow control portion of the control system.
Figure 14:
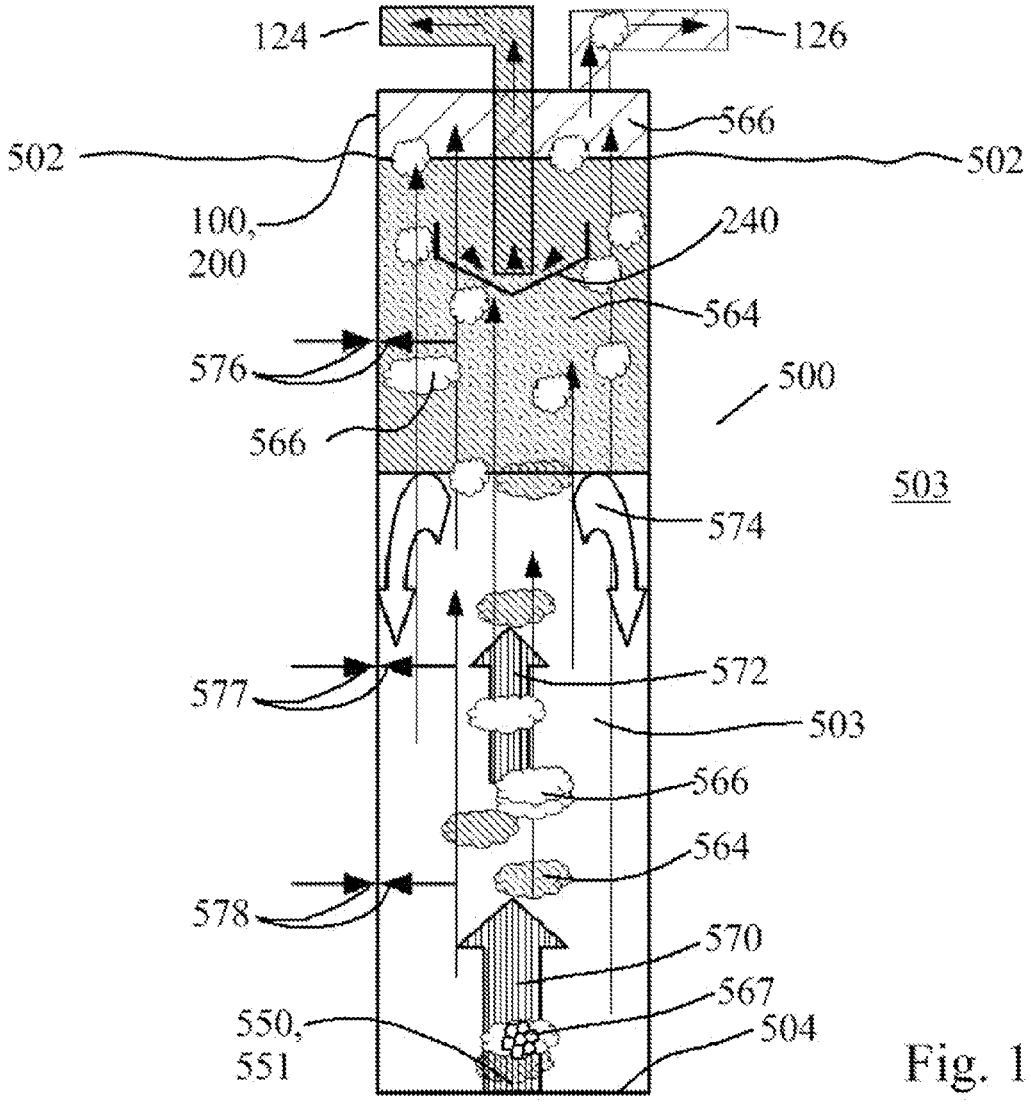
FIG. 14 illustrates a 4 phase solid, liquid and gas model of the Floating Platform Rigid Enclosure, Self-Supporting Flexible Containment Enclosure (SSFCE) and Bubble Diverting Assembly.
Figure 15:
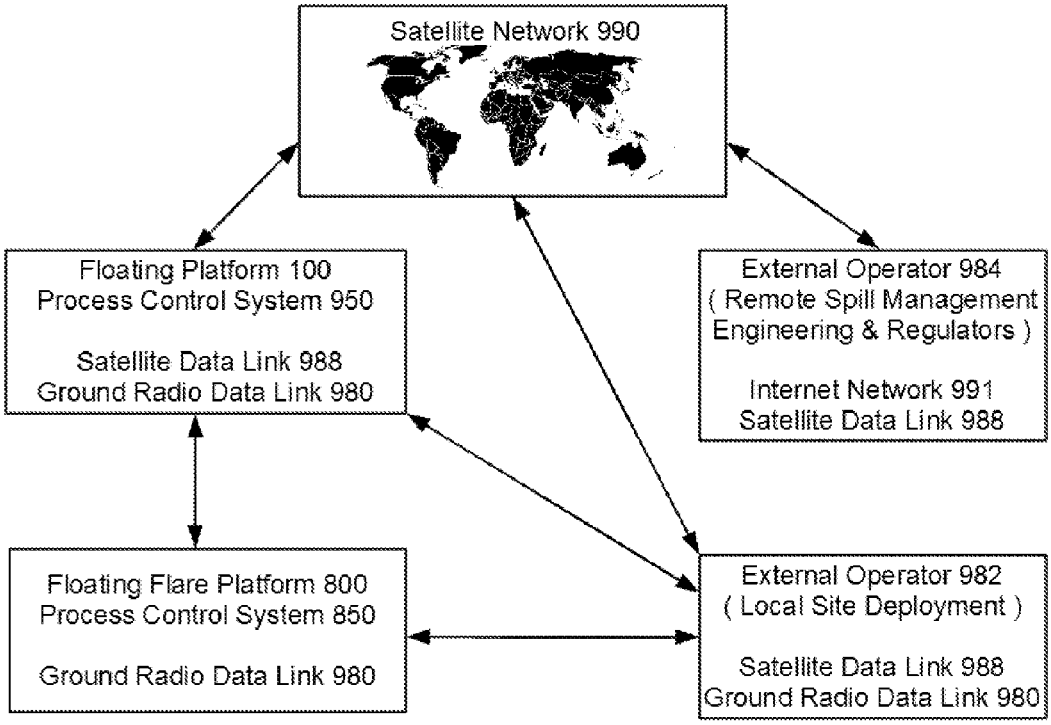
FIG. 15 illustrates communication pathway options.

The subsea hydrocarbon collection and containment system of the present invention comprises a self-supporting flexible containment enclosure (SSFCE) 500 for capturing the leaking hydrocarbons, and a floating platform 100 having a rigid enclosure 200 in which gaseous and liquid products from the captured hydrocarbons are separated. Floating platform 100 routes the liquid and gaseous products for further handling. FIGS. 1 and 2 illustrate floating platform 100. FIGS. 3-5 illustrate SSFCE 500. FIGS. 6 and 7 show examples of connections between SSFCE 500 and leak sources 550 (such as sea floor fissures or broken wellheads). FIG. 8 shows a floating flare platform 800 capable of burning off gaseous product provided by floating platform 100. FIG. 9 is a block diagram illustrating buoyancy control logic for floating platform 100 flotation vessels 102. FIG. 10 provides a flowchart of product flow from origination to potential destinations. FIG. 11 is a flow diagram showing an example of a Process Control System 950 form monitoring and controlling operations. FIG. 12 is a flow diagram showing an example of a Process Control System 850 for monitoring and controlling operations. FIG. 13 is a flow diagram and illustrates an example of the fluid flow control portion of the control system. FIG. 14 illustrates a 4 phase solid, liquid and gas model of the Floating Platform 100 Rigid Enclosure 200, Self-Supporting Flexible Containment Enclosure (SSFCE) 500 and Bubble Diverting Assembly 240. FIG. 15 illustrates communication pathway options.

Figure 1B:
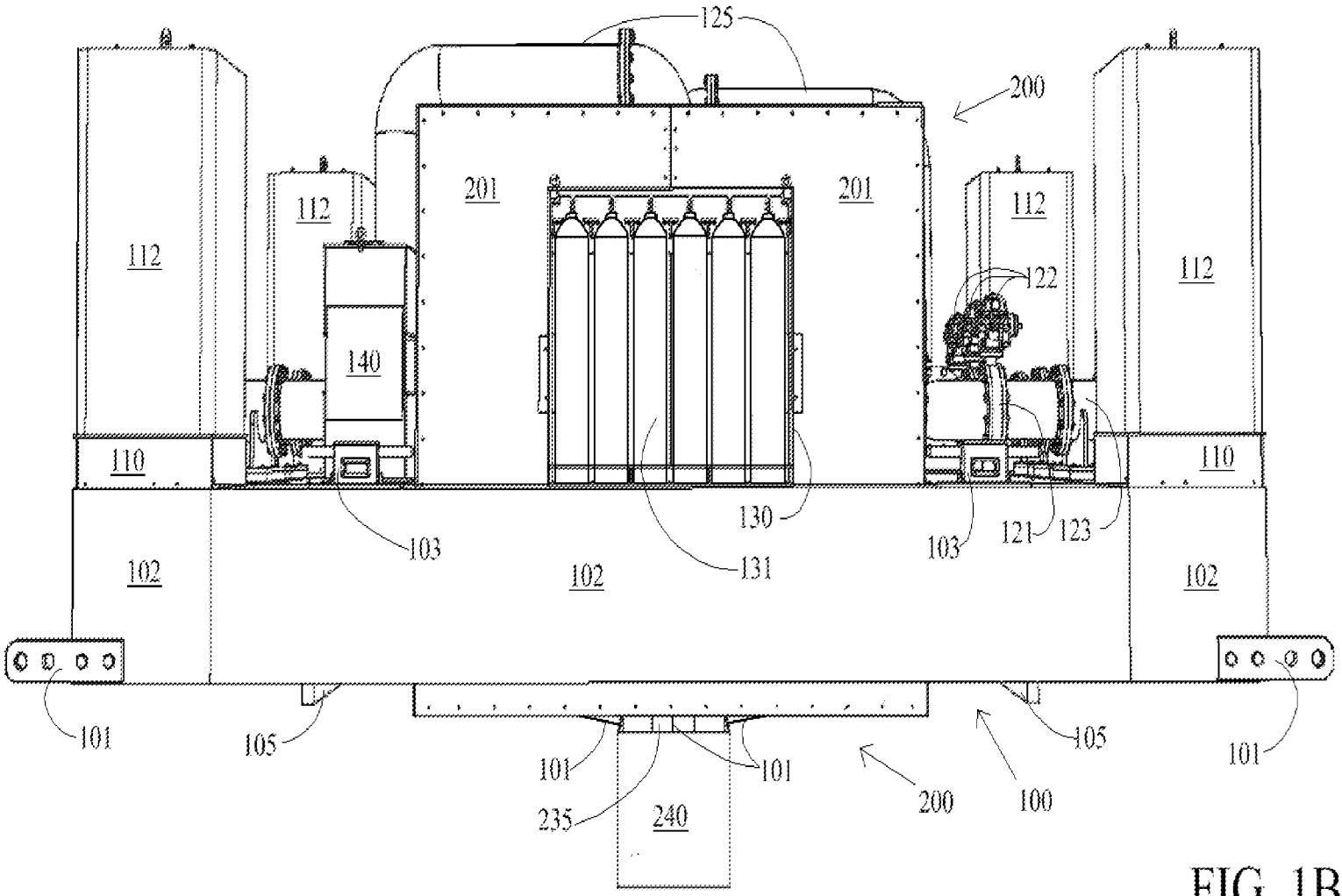
FIG. 1B shows a side view of the floating platform of FIG. 1A.
Figure 1C:
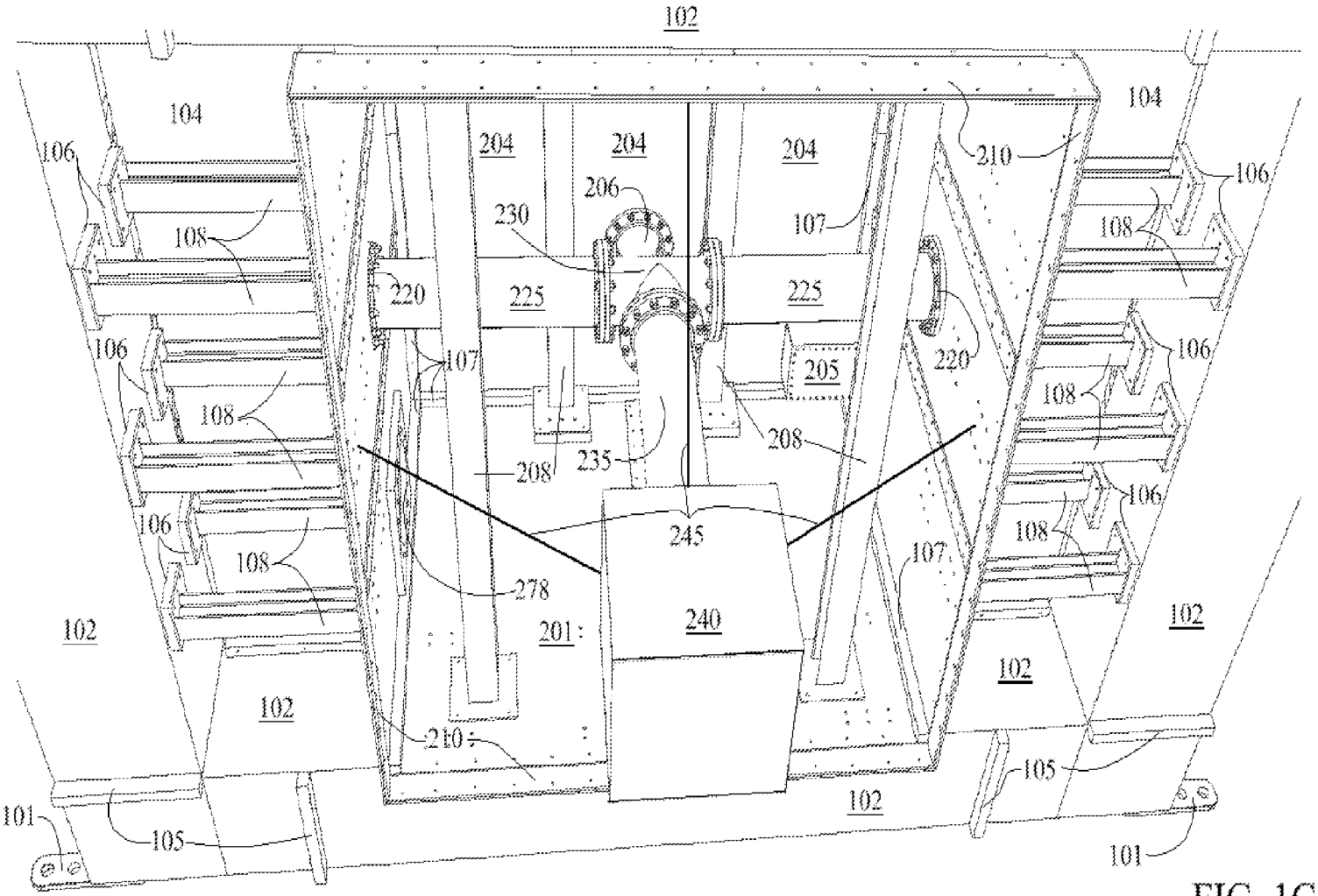
FIG. 1C shows an isometric bottom view of the floating platform of FIGS. 1A and 1B.
Figure 1D:
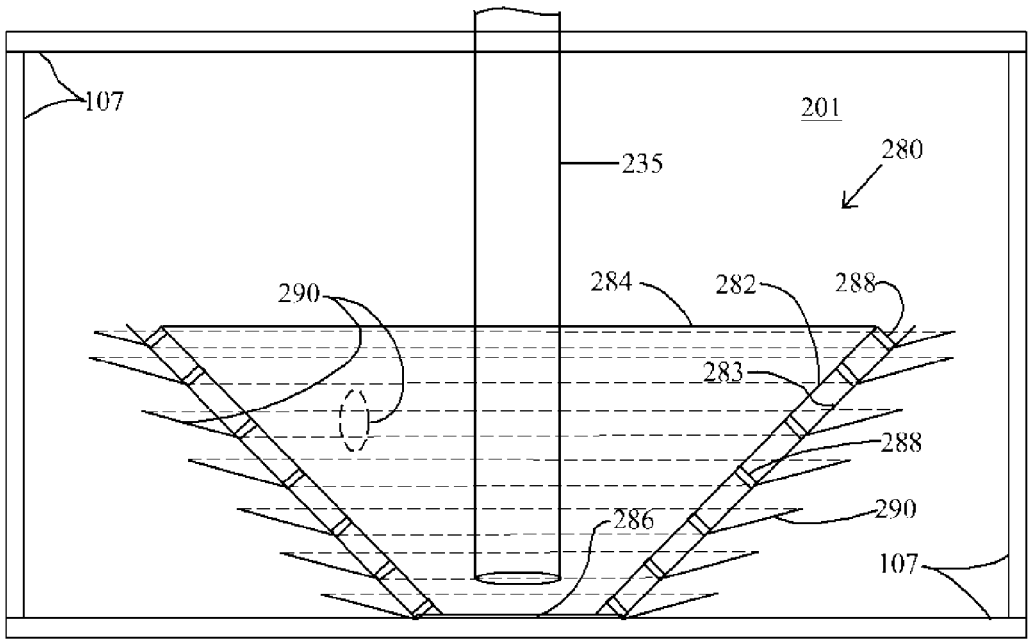
FIG. 1D is a side cutaway view of one example of a bubble diverter according to the present invention.

FIG. 1 comprises FIG. 1A, showing a top view of floating platform 100, FIG. 1B, showing a side view of floating platform 100, FIG. 1C, showing an isometric bottom view of floating platform 100, and FIG. 1D, showing a side view of a Rigid Enclosure Bubble Diverter 280 an extension of the Rigid enclosure 200 and containing within a Bubble Diverter 280. Floating platform 100 includes flotation vessels 102, rigid enclosure 200 (in which liquid and gaseous products from the captured hydrocarbons are separated), and various piping and valves for handling liquid and gaseous products from self-supporting flexible containment enclosure (SSFCE) 502 shown in FIGS. 3-5 after they are separated within rigid enclosure 200.

FIG. 1A shows floating platform 100 from the top (including some perspective), showing floating platform upper deck 104, upper deck 204 of rigid enclosure 200, flotation vessels 102, and various ports, enclosures and hardware. Flotation vessels 102 support the structure, and allow it to float or submerge as desired. FIG. 9 shows buoyancy control logic controlling floating platform 100 draft via flotation vessels 102. FIG. 11 shows Process Control System 950 which monitors and controls draft, flow control, buoyancy and other operations.

This submergence capability provides an increased level of reliability for floating platform 100, avoiding heaving seas prior to and during hurricanes as well as other surface disturbances or threats such as above surface flammable situations. Floating platform 100 may be partly or fully submerged to a depth at which there is minimal turbulence, protecting it from excessive mechanical loading and or stresses. Floating platform 100 can continue its functions of separating liquid and gaseous products from captured hydrocarbons in conjunction with attached SSFCE 500 while partly or fully submerged.

100A is the "Aft" or rear end of platform 100 looking forward, 100B is the "Bow" or front end, 100P is the "Port" or left side, and 100S is the "Starboard" or right side.

The system is able to direct the output products concurrently to multiple ports with, for example the gaseous product output ported between the 100A aft port and 100B Bow port and the liquid product output directed among two 100B Bow ports and one 100A Aft port.

Locator buoys 112 are attached to Locator buoy support enclosures 110, which are attached to Flotation vessel 102

Liquid products are removed from Rigid enclosure 200 bulkhead flange Gaseous product port connection 206 via Valve assembly 120. The liquid products then pass through Pipe assembly 123 to liquid product port 124. Pipe assembly 123 comprise "Stubs with Flanges"—pipe extenders used for both gas and liquid products and consisting of a pipe assemblage with pipe flanges and welded flanges for bolting onto welded plates. Five of these are common and are shown in FIG. 1A (for liquid ports 124 and gas ports 126). A double ended pipe with flanges and with two sets of support base mounting flanges form this Pipe assembly 123. For example Pipe Assembly 123 might be a custom fabricated dual square base flanged mounting for a pipe segment with pipe flanges on each end.

Gaseous product is removed from rigid enclosure 200 via port connections 206 on Rigid enclosure upper deck 204 and passes via pipe segments 125, through Valve assemblies 120. The gaseous product then passes through Pipe assembly 123 to Gaseous product ports 126.

Valve assemblies 120 are operated by the Process Control System shown in FIG. 11. Compressed air tanks 131 are configured in a cascade array 130 which allows for buoyancy control (as shown in FIG. 9). Cleats 103 provide securing points for lines and the like. Watertight enclosures 140 house various equipment.

FIG. 1B is a side view (including some perspective) of floating vessel 100. In addition to the elements shown in FIG. 1A, FIG. 1B shows mooring points 101, butterfly valves 121 and electrically controlled valve actuators (for example digitally controlled rotary actuators) 122 of valve assemblies 120, walls 201 of rigid enclosure 200 and several elements extending below flotation vessels 102.

Flotation vessel support blocks 105, lower perimeter mating assembly 210 of rigid enclosure 200, liquid product Bubble diverting assembly 240, liquid product submerged conduit 235, and liquid product bubble diverting assembly stays 245 are also visible.

FIG. 1C is an isometric bottom view of floating platform 100. This view best illustrates the interior of rigid enclosure 200, as well as some structural aspects of flotation platform 100 (such as structural beam assemblies 108 and 208).

Floating Platform 100 and Rigid Enclosure 200 might alternatively be assembled with weldments replacing the majority of assemblages that are connected using conventional fasteners engaged into drilled and or tapped members. In this preferred embodiment the structure is illustrated with the majority of assemblages being assembled with fasteners, aiding in the ability to transport individual components taking into consideration logistics and available transportation modes.

Vertical Walls 201 are secured by Drilled and Tapped Mounting Block 106 welded to flotation Vessel 102 and also secured to Drilled and Tapped Solid Vertical and Horizontal Bars 107 along with Upper Deck 204 that comprise and form the structure of the Rigid Enclosure 200 located within the floating platform 100. Vertical walls 201 are additionally secured using Exterior Structural beam assembly 108 connected to Drilled and Tapped Mounting Block 106. Drilled and Tapped Mounting Blocks 106 are welded into place at various locations on the flotation Vessel 102.

In a preferred embodiment, all mating vertical wall 201 and upper deck 204 surfaces connected to vertical and horizontal bars 107 have an appropriate gasket material like Buna-N, Viton, etc. to provide for a watertight seal including hinged door assembly 276 and manhole port 202 and other appropriate locations.

In a preferred embodiment, Watertight sensor enclosures 205 may be incorporated within Rigid Enclosure 200 and may contain various equipment (not shown) such as pulsed radar liquid level sensors, laser liquid level sensors, pressure sensors providing redundant sensing, a wide angle low light internally mounted video camera looking downward, and a downward projecting LED lighting source. Each Watertight sensor enclosure 205 is preferably provided with a clear Polycarbonate Lexan™ MR-10 bottom cover (not shown) for viewing, inspection and access. The aforementioned liquid level and pressure sensors might be mounted through the clear Polycarbonate Lexan™ MR-10 bottom cover.

Liquid product Bubble diverting assembly 240 prevents gaseous product from entering the recessed ingress flange (not shown) located in the lower section of the Bubble diverting assembly 240. The gaseous product will rise vertically adjacent to Bubble diverting assembly 240 and continue its upward ascension above Bubble diverting assembly 240 into the interior of Rigid Enclosure 200 and into Gaseous product connection 206. Bubble diverting assembly 240 enables liquid product within the Bubble diverting assembly 240 enclosure to travel upward via downward submerged conduit 235 via liquid product Internal tee 230 to liquid product Lateral conduit 225. The liquid product then passes through Liquid product port bulkhead connections 220, with the flow controlled by Valve assemblies 120, and then passes through Pipe assembly 123 and on to Liquid product ports 124. Bubble diverting assembly Stays 245 might be connected between the interior Rigid enclosure vertical walls 201 or other members within the Rigid Enclosure 200 and the Bubble diverting assembly 240 for the purpose of providing mechanical stability. The interior of Rigid Enclosure 200 might contain one or more Bubble diverting assemblies 240 and further might incorporate directional louvers for directing or channeling gaseous product 566 away from the ingress of the Bubble diverting assembly 240.

FIG. 1D illustrates an alternative to Bubble Diverting assembly 240 shown in FIG. 1C. Rigid Enclosure Bubble Diverter 280 is a lower extension of Rigid enclosure 200 and containing within Bubble Diverter 280 attached to enclosure walls 201 and Drilled and tapped solid vertical and horizontal bars 107 provide a walled structure with an open bottom and top that may further comprise a lower horizontal framework using for example the Drilled and tapped solid vertical and horizontal bars 107.

Bubble diverter 280 may have a frustum, trapezoidal or conical shaped vertical surface with a closed bottom with an open area at the top supported by members from the bottom or sides extending outward and connected to the surrounding structure and providing an opening around the lower perimeter as to allow the ascending liquid and gaseous product to rise adjacent to the exterior of Bubble diverting assembly 280 while conversely disallowing the gaseous product from descending within the interior of the bubble diverting assembly 280 where an open ended conduit is in proximity to the lower inside portion of the bubble diverting assembly 280. Furthermore, Bubble diverting assembly 280 may have fins or slats 290 connected to standoffs 288 or may be further secured to an exterior wall 283 attached to the standoffs with exterior wall 283 comprising for example a plurality of elongated lateral open slots between the attached fins 290. In the aforementioned assembly fins 290 are secured to an exterior wall 283 and attached to interior wall 282 of bubble diverting assembly 280 by standoffs 288. This establishes a collective region between interior wall 282 and exterior wall 283 for liquid product flow and provides a minimal introduction of gas bubbles within said region. It further allows the liquid product to flow along the exterior of the interior wall and over upper opening 284 perimeter edge of bubble diverting assembly 280. FIG. 1D shows a Bubble diverter fin 290 with a pair of dashed lines that represent a front or rear aspect of a fin as opposed to an edge or side view.

The Bubble diverting assembly 280 upper opening 284 is located substantially below the anticipated lower boundary of the variable gas liquid interface level within the rigid enclosure 200 and the uppermost portion of the SSFCE 500. Furthermore, a port (not shown) that can be opened or closed remotely or manually might be introduced at the lower portion of the Bubble diverting assembly 280 interior wall 282 to initially allow a liquid to fill the volume or drain such volume within said assembly.

Figure 2A:
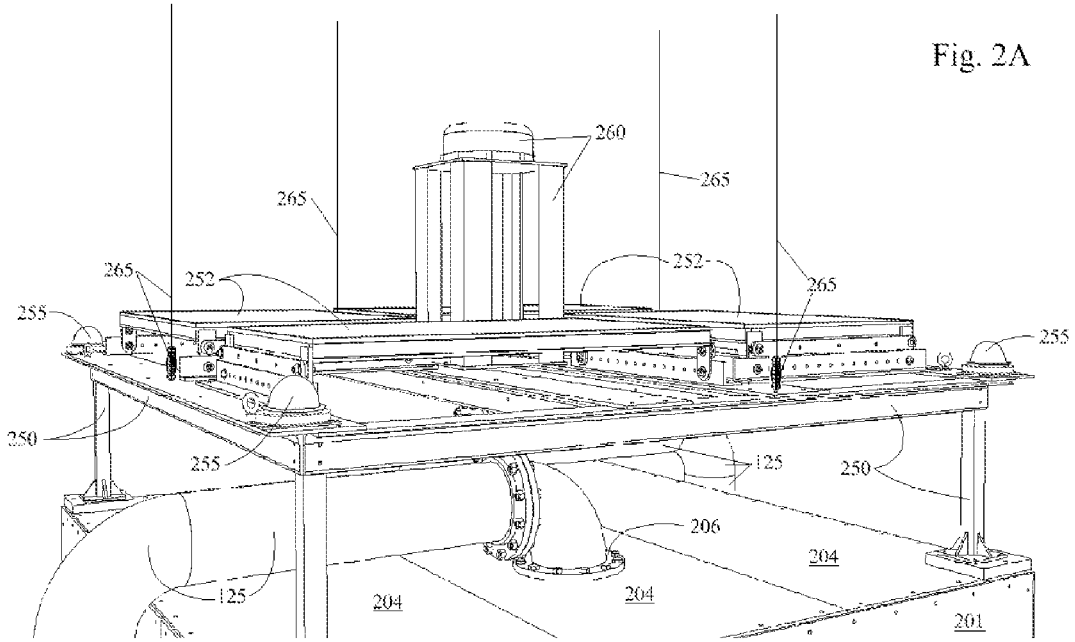
FIGS. 2A, 2B, 2C, and 2D show detailed views of portions of the floating platform of FIG. 1.

FIG. 2 comprises FIGS. 2A, 2B, 2C, and 2D, and shows detailed views of portions of floating platform 100 of FIG. 1. FIG. 2A is an isometric side view of a solar panel elevated assembly comprising an elevated structure 250 supporting watertight solar panels 252 including adjustable angle assemblies attached to the 200 Rigid enclosure Rigid enclosure upper deck 204. The Floating platform 100 may obtain its power for operation from the plurality of Watertight solar panels 252 that charge batteries (not shown) enclosed within one of the Watertight enclosures 140. Structure 250 also supports navigation lighting aids 255, antennas and support structure 260 and lightning arresters 265.

Figure 2B:
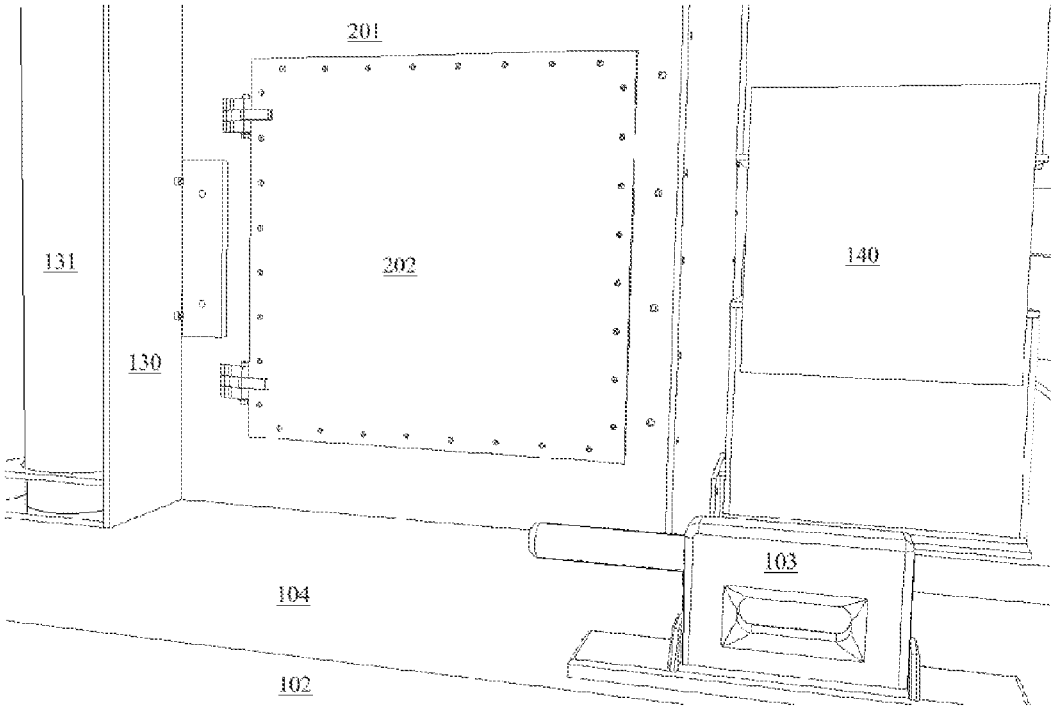

FIG. 2B is an isometric side view of a hinged manhole port 202 allowing entry into rigid enclosure 200 via wall 201. A watertight equipment enclosure 140 (side view) is seen to the right of manhole cover 202 and compressed air tank enclosure 130 (showing one of a plurality of air tanks 131) is seen to the left.

Figure 2C:
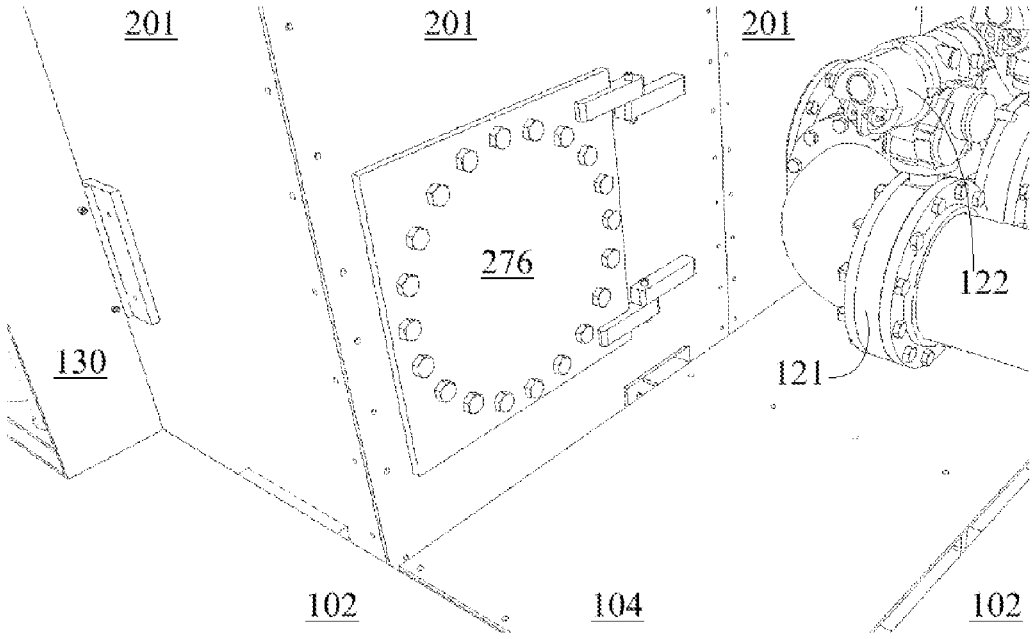

FIG. 2C is an isometric side view of the Outrigger pump discharge external bulkhead port 276 with hinged door bolted to the Outrigger pump discharge port interior bulkhead flange 278 formed in a side wall 201 of rigid enclosure 200. The Outrigger pump discharge port internal bulkhead flange 278 can be seen in FIG. 1C. Outrigger pump assembly 150 is connected as shown in FIG. 2D.

Figure 2D:
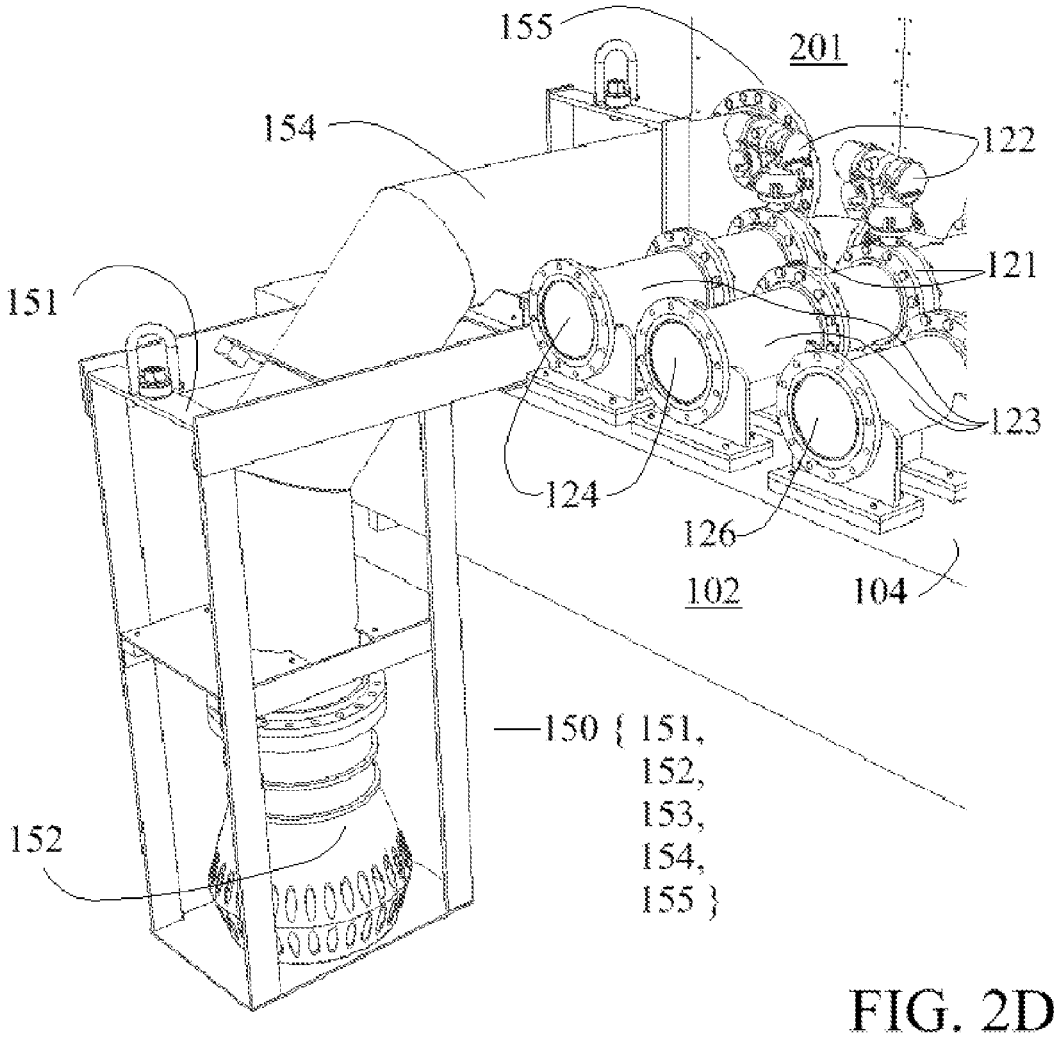

One embodiment for the introduction of water into SSFCE 500 is by way of a temporarily installed outrigger pump assembly containing a hydraulically operated axial flow pump as shown in FIG. 2D.

Outrigger pump assembly 150 is temporarily secured to the Floating platform 100 providing a connection with Flange 155 to Rigid enclosure 200 sidewall 201 formed port Outrigger pump discharge port internal bulkhead flange 278 shown in FIG. 1C. Outrigger pump 152 pumps seawater into rigid enclosure 200, to fill SSFCE 500 to partial capacity.

FIG. 2D is an isometric side view of Outrigger pump assembly 150, used to pump seawater into rigid enclosure 200, to fill the SSFCE to partial capacity. Locator buoy support enclosure 110, Locator buoy 112 and external bulkhead port attached hinged door 276 have been removed for clarity. Outrigger pump 152 connects to Outrigger pump discharge pipe assembly 154, supported by Outrigger pump assembly frame 151. Outrigger pump discharge pipe assembly 154 terminates at Outrigger Pump discharge port flange 155 and makes a bulkhead connection to Outrigger Pump discharge port internal bulkhead flange 278 via the Rigid enclosure 200 sidewall 201.

Outrigger pump 152 in this embodiment is an Axial flow pump and may be operated by hydraulics using, for example, an external diesel power unit 159 (not shown) having a hydraulic pump 156 (not shown), and hydraulic lines 158 (not shown) connected to a hydraulic motor 157 (not shown) operating an impeller (not shown) within the outrigger pump 152 housing. An ultrasonic liquid flow sensor 753 (not shown) might be attached to Outrigger pump discharge pipe segment 154 for the measurement of flow and volume of the liquid introduced into the SSFCE 500.

SSFCE 500 is generally assembled in segments 300, attaching components such as Subsea buoys 520 and Tethered cable connection lanyards 518 and Mooring lines 510 as required.

SSFCE containment enclosure 500 creates an "Ocean within an ocean" system, capturing and containing all of the leaking hydrocarbons as well as containing a great deal of seawater. SSFCE 500 might be deployed horizontally and empty on the surface of the water 502. The Subsea terminator interface assembly 600 end of SSFCE 500 is then drawn down or pulled toward the targeted area of hydrocarbon emissions 502 by a remote operated vehicle (ROV, not shown) or other means. During the descent, SSFCE 500 is partially filled with seawater via Outrigger pump assembly 150 being temporarily secured to Floating platform 100. The water pumped into SSFCE 500 creates a transport medium for the oil and gas hydrocarbon emissions.

The SSFCE 500 contained water volume is based on the total volumetric capacity of SSFCE 500 minus the anticipated worst case mean flow rate and/or volume during transit of the liquid and gaseous hydrocarbons minus a percentage of the SSFCE 500 total volume to allow for dynamic changes and to provide a buffer for, e.g. compressive forces upon SSFCE 500, changes in flow rates, additionally introduced reservoir water, etc. These factors and others not mentioned might provide guidance for the volume of water required as a liquid transport media.

Outrigger pump assembly 150 is removed and the Outrigger pump discharge external bulkhead port with hinged door 276 is secured to Outrigger pump discharge port internal bulkhead flange 278 after operations to partially fill the SSFCE 500 are completed.

In a preferred embodiment, SSFCE 500 comprises adjoined segments 300, each comprising panels 302 formed of, for example, a non-elastic geomembrane fabric. Segments 300 are connected at their edges to form tubes. Buoys 520 comprise Positive Offset Neutral Buoyancy attachment Devices (PONBADs) and are used to fine tune the buoyancy requirements of segments 300 based upon their location and function by adjusting the buoyancy value required by the addition or subtraction internally or externally specific amounts of weight The segments include structure along their edges which allows the segments to be attached to form SSFCE 500.

FIG. 3 comprises FIGS. 3A through 3L, and shows various views of SSFCE 500 segments 300. An SSFCE segment 300 is a tube formed of panels 302 affixed together and supported by straps 308. The segments are then connected, for example via hook-and-loop connections, to achieve the desired SSFCE 500 length.

Straps 308 connect together at their ends provide the main vertical mechanical support loading between segments 300 and the hook and loop connections 303 and 305 are primarily used as the interconnects providing a continuation of the SSFCE segment 300 function in the transport of material emanating from the hydrocarbon leak.

Figure 3C:
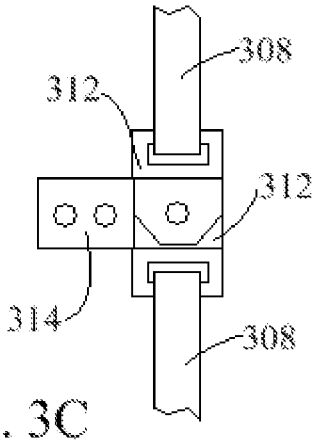
FIGS. 3A through 3L show various views of SSFCE segments.
Figure 3B:
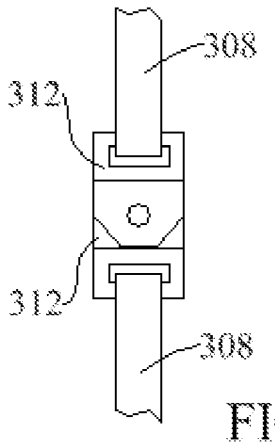
Figure 3A:
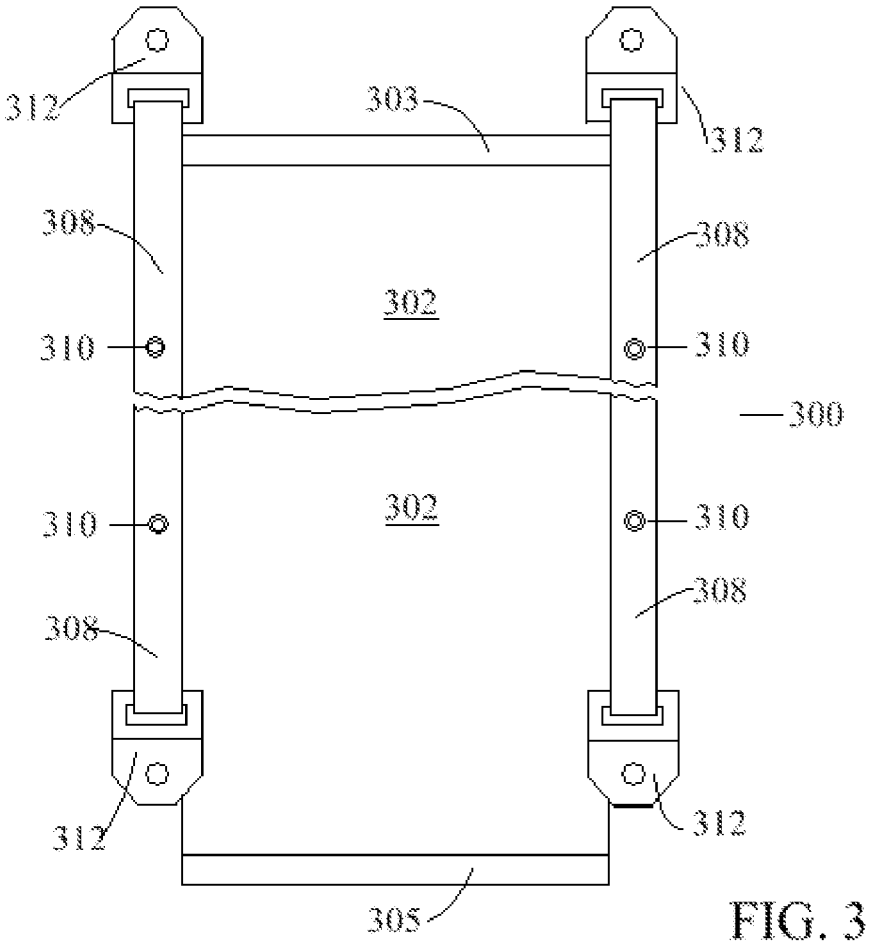

FIG. 3A is side isometric view of a first embodiment of an SSFCE segment 300 including panels 302, support straps 308 and strap termination points 312 for connecting adjacent segments 300. As an example, panels 302 might comprise 500 foot by 100 inch pieces of high-performance reinforced geomembrane such as Seaman XR5 8130 EIA (Ethylene Interpolymer Alloy) Polyester.

Furthermore the panel material used in the SSFCE segments might also include additional layers or laminations of the same or different material to the interior or the exterior for purposes such as strength and or thermal considerations.

Those skilled in the art will appreciate that this is just one example, and many variations are possible. For example, the length or diameter of segments 300 may be different.

Segment 300 lengths of approximately 500 feet work very well due to fabrication, weight, counter-buoyancy requirements, logistics handling, etc. Longer or larger diameter segments 300 would require an increase in the number and/or the size of subsea buoyancy modules 520 to reduce the total topside loading.

Segments 300 can be made of other materials and may have frustums or other geometrical characteristics that may be symmetrical or asymmetrical in geometry. Segments 300 are not limited to four panels in construction, as they might comprise one or more panels with or without a plurality of straps.

Four panels 302 are welded together, creating seams along their long edges to form a 500-foot tube. There are many methods of welding panels together, e.g. Hot Air Wedge, Contact Hot Wedge, Radio-Frequency weldments, extrusion fillet weldments, chemical bonding adhesives.

Support straps 308 might comprise 4-inch-wide polyester strap material folded in half to cover the 2 inch wide hot wedge weldment and dual double stitched to the weldment using for example a Gore Industries Tenara thread. Additional stitching of the Support straps 308 may be of benefit including variations of stitch patterns, thread of other means of attachment.

Widths and lengths of the material for the seams, stitching, straps and panels may all be variable in size and material.

Eyelets or grommets 310 are inserted in support straps 308 to allow attachment of mooring lines, tethered loop handles, rings or carabiners and to further allow operators to easily handle, tow and manipulate segments.

Figure 4B:
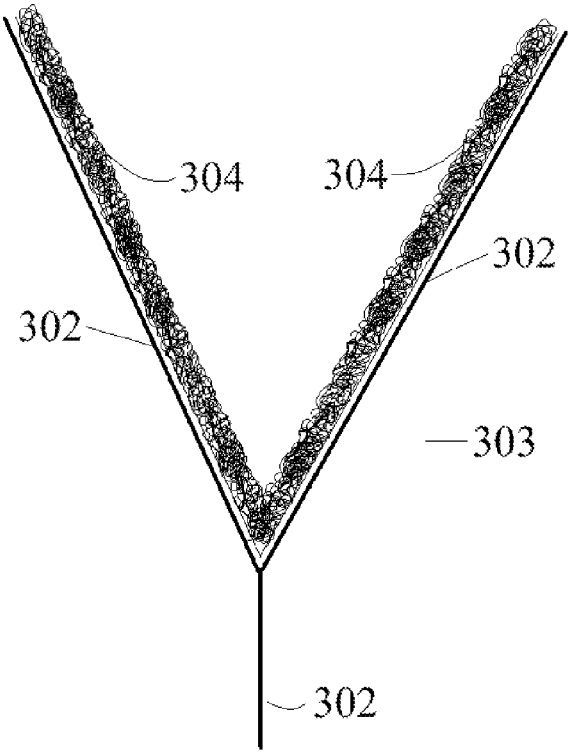
FIGS. 4A-4F show detailed side views of various hook-and-loop connections between segments.

At the top of segment 300, along the short edges of panels 302, is disposed, for example, a loop material 304 in Y-shaped flaps 303 (as shown in FIG. 4B) or some other configuration. In this case, hook material 306 formed on I-shaped flap 305 is disposed at the bottom of segment 300 along the short edges of panels 302 in a configuration selected to engage with loop material 304 at the top of the next segment 300. This hook-and-loop connection is the main connection between segments, and provides a nearly waterproof seal. There is less chance of intrusion of the oil and gas into the connection, as those fluids are moving vertically upward and along the surface and the system typically is not under pressure. If the orientation was the other way, one could potentially have seepage of the compromised fluids into the inside portion of the connection. Straps 308 provide further the main structural support and connection between segments.

FIG. 3B is a detailed view of connected strap termination points 312, to provide the primary vertical load bearing connection between one segment 300 and another. For example, termination points 312 might be formed of 316 Stainless Steel and comprise a terminator strap connector with a bolt hole for connecting two strap segments 308 (the bolt and nut connection—or other fastener—is not shown). Termination point 312 might also consist of one or more bolt holes to connect with another termination point 312 and matching number of bolt holes for connecting the protruding attachment point 314.

FIG. 3C is a detailed view of connected strap termination points as in FIG. 3A, further including a protruding attachment point 314 for connecting a buoy 520 (see FIG. 5) and or engaging mooring or other lines, cables, etc.

Figure 3D:
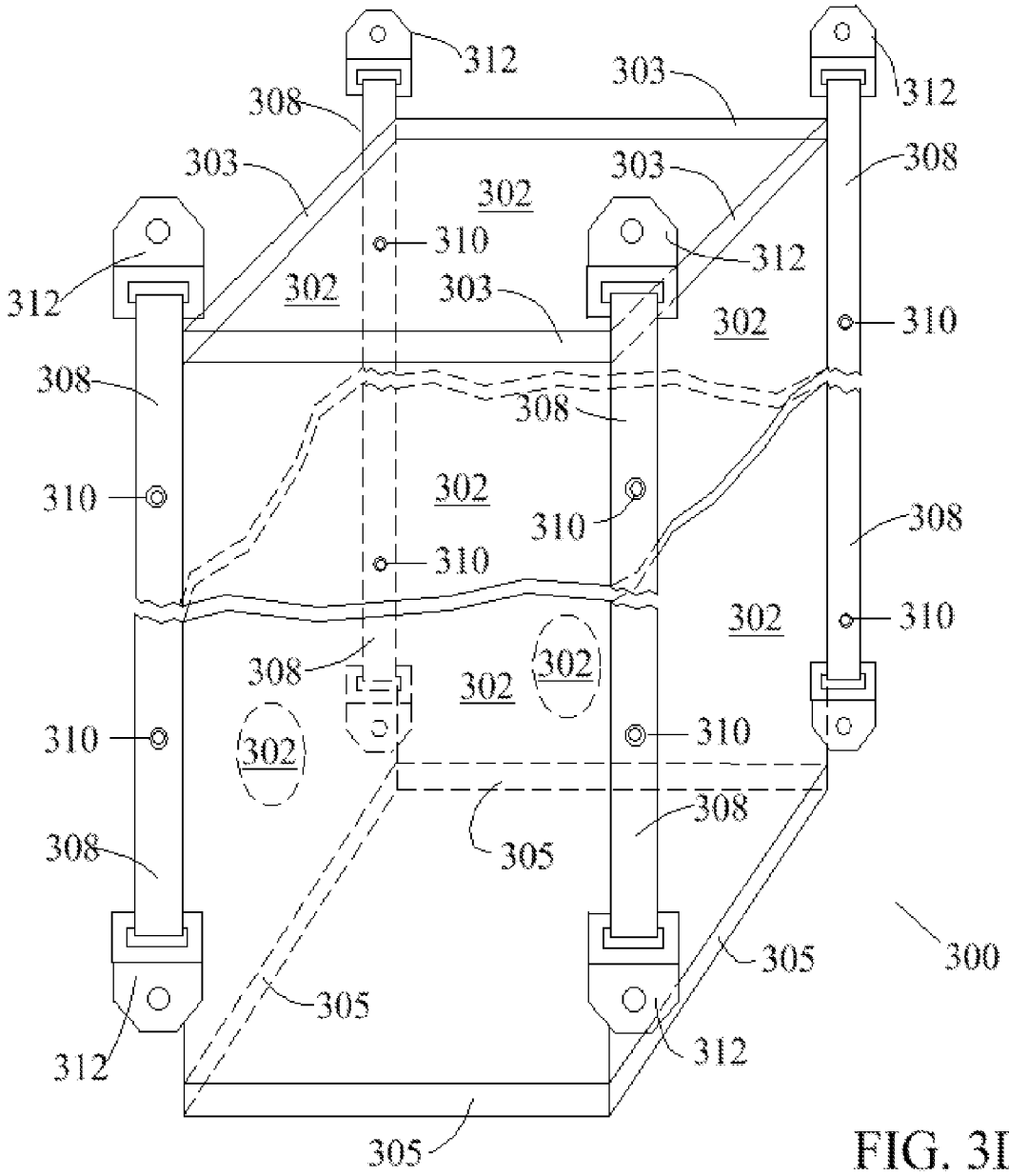

FIG. 3D is a detailed oblique wireframe view of SSFCE Segment 300.

Figure 3E:
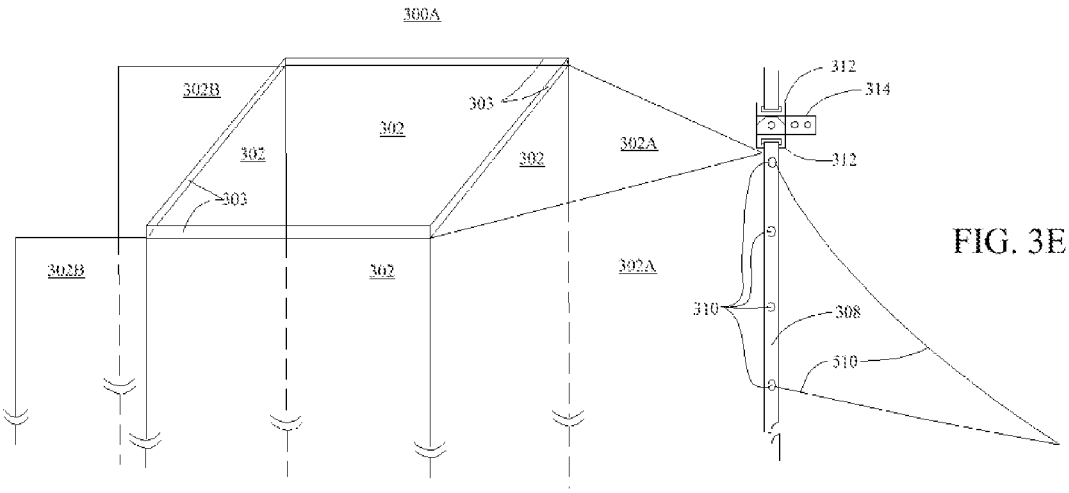

FIG. 3E is an isometric view of a second embodiment of an SSFCE 300A segment section comprising SSFCE 300 as in FIG. 3D, further including drag coefficient reduction panels 302A and tail flap panels 302B. Construction of SSFCE 300A segments might include the attachment and welding of 302A panels to 302 panels during the construction of SSFCE segment 300A with the subsequent attachment of straps 308 and eyelets 310 and or grommets 310, etc. Panels 302A are the main constituents of the drag coefficient reduction system and panels 302B assist in reducing drag and turbidity, vortex turbulence, etc.

Figure 3F:
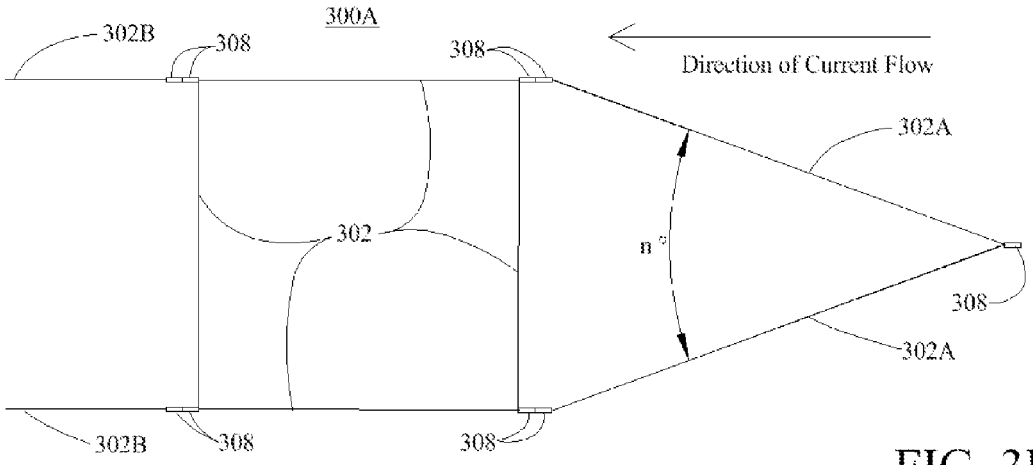
Figure 3G:
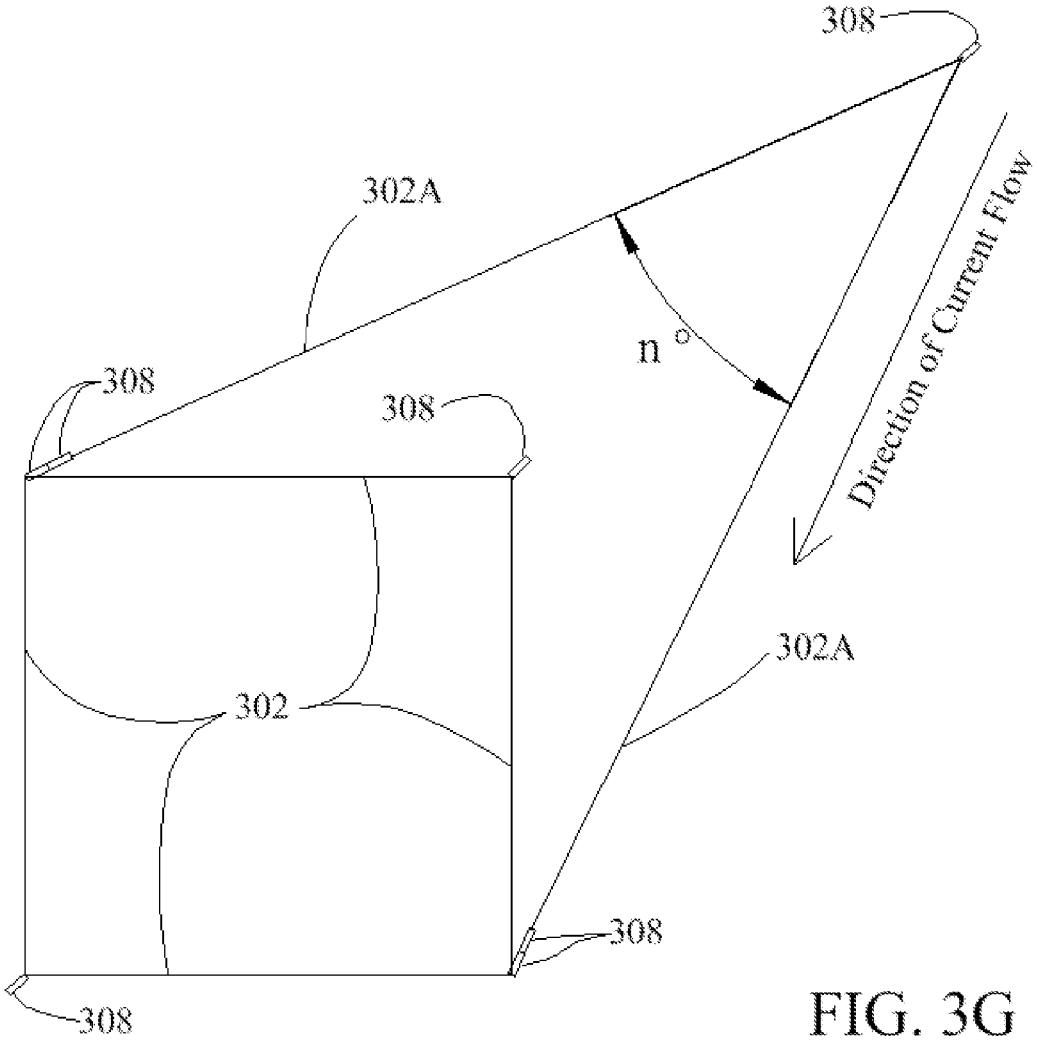

FIG. 3F is a top view of the segment 300A of FIG. 3E. FIG. 3G is a variation on the segment 300A of FIG. 3E where the drag coefficient reduction panels are connected using both opposing edges of the SSFCE segment (or in some cases opposing edges of two or more SSFCE segments).

Figure 3H:
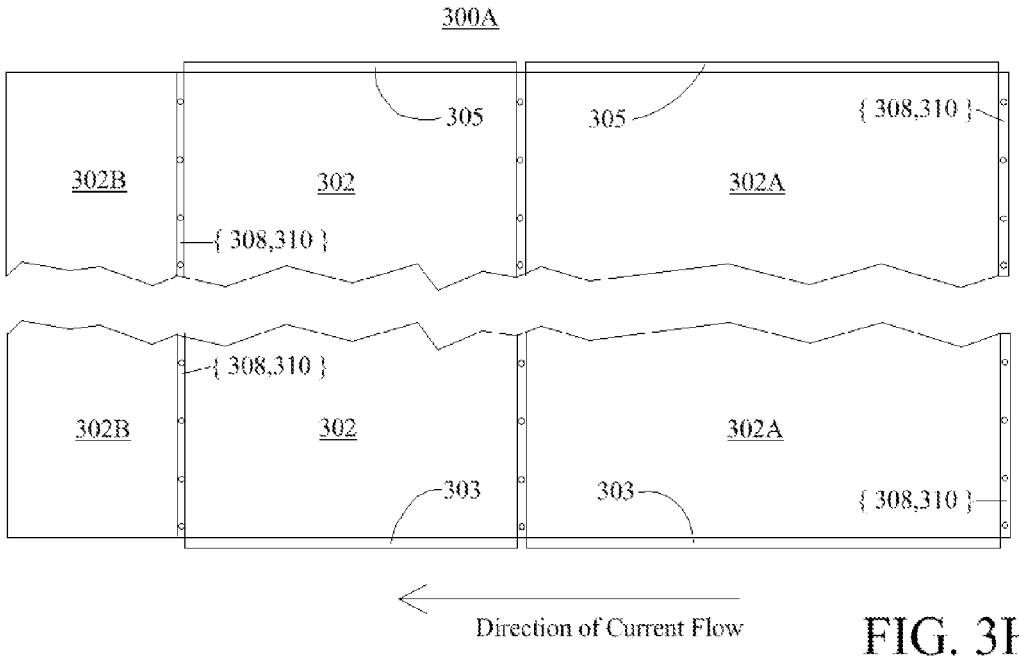

FIG. 3H is a side view of the segment of FIG. 3E.

Figure 3J:
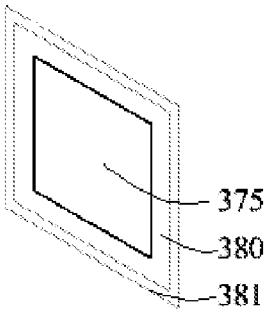
Figure 3K:
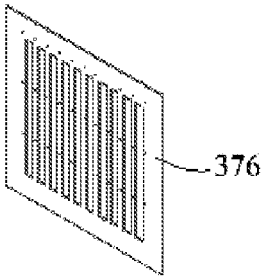
Figure 3L:
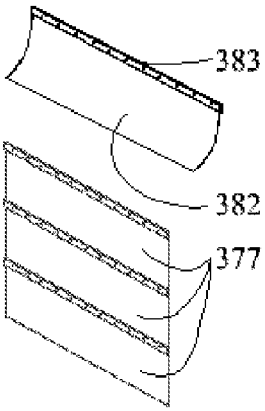
Figure 3I:
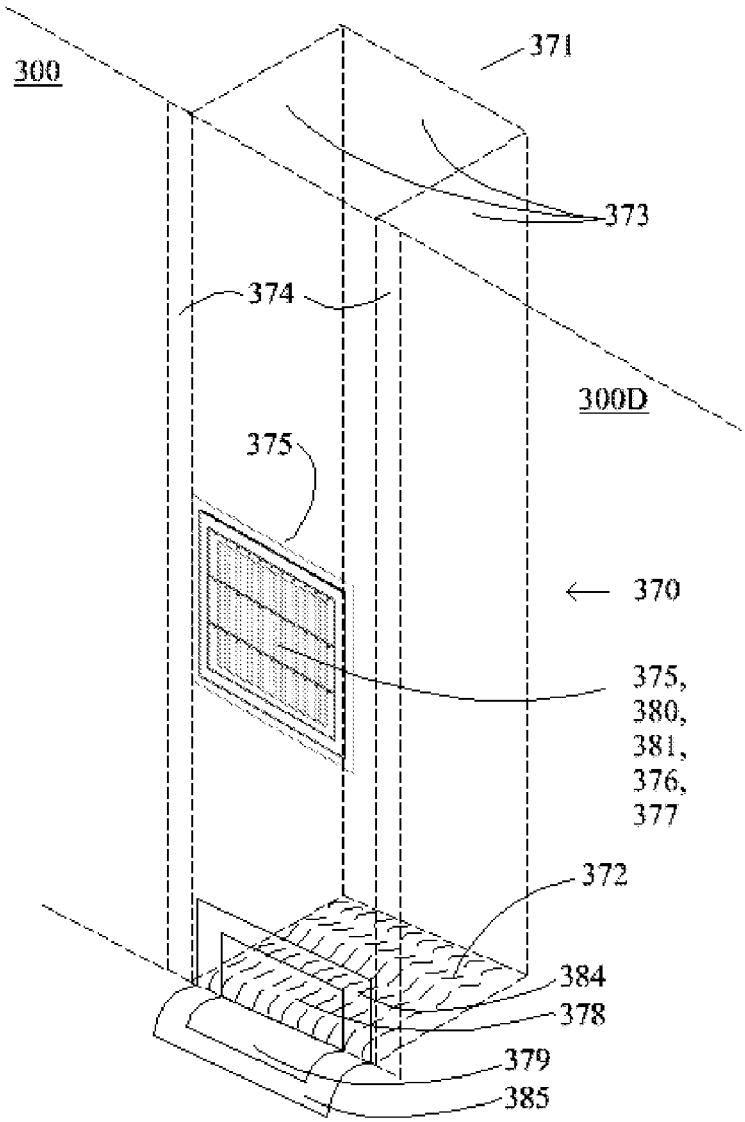

FIG. 3I illustrates an embodiment of a SSFCE segment 300, which includes an internal Relief port 370 attached to the inside of SSFCE segment 300D with flanges 374. Relief port 370 has an opening 371 at its top terminus and a closed bottom terminus 372. Relief port 370 is installed below the maximum anticipated lower boundary depth of any accumulation of liquid and or emulsified hydrocarbon product.

The surface of SSFCE segment 300D has a partitioned opening constructed to accommodate a One-way port 375 further comprising a slotted semi-flexible plate 376 shown in FIG. 3K and exterior attached membrane flaps 377 secured by battens 383, attached to a flexible membrane material 382 both shown in FIG. 3L forming the completed assembly membrane flap 377. FIG. 3J illustrates the placement of One-way port 375 with both an internal membrane 381 gasket panel and external membrane 380 gasket panel that is attached around the perimeter of One-way port 375 internally and externally and further secured to SSFCE segment 300D.

Relief port 370 has at its lower terminus a closed bottom 372 with an access opening 378 that might further comprise an attached membrane flap 379 having an interior perimeter of a hook or loop closure material that creates a seal when secured to opposing hook or loop closure material 384 that is formed around outer exterior perimeter opening 378.

Opening 378 of Relief port 370 is located below One-way port 375 and allows for the removal of precipitated material that might accumulate. This reduces the probability of obstructing the openings formed on slotted semi-flexible plate 376. Variations in this design are possible. The terminus of Relief port 370 might have a different opening and access method. The geometry of Relief port 370 might vary. The embodiment might further include an exterior conduit or channel connected to One-way port 375 for other purposes.

Other variations on SSFCE segments 300D might include an external port connection on the SSFCE segment side to connect an internal tube made partially buoyant ascending vertically to further reduce the probability of gaseous and liquid compromised emissions from entering downwardly into the tube and allowing for the relief to the exterior of excess water volume. A further variation might introduce to this side port a descending weighted tube to further disallow gaseous and liquid compromised emissions from descending into the external side port (as such materials are typically buoyant). This embodiment might further be revised to incorporate a channel constructed of panel material to replace the aforementioned internal and external tubes that interface with SSFCE segment 300D side mounted port. This embodiment may further include a channel or tube connection continuing below the SSFCE segment 300D side mounted port descending downward on the interior of the SSFCE segment 300D for a distance to a separate port that might have a hook and flap arrangement for closure for the purpose of collecting any precipitated particulate having a density greater than the water media such that material is accumulated in the enclosed volume and is able to be removed at a later time, while primarily decreasing the probability that any descending material would interfere with the operation of the aforementioned glands membrane glands.

A further variation might incorporate a flexible membrane type gland comprising a number of slits operating like a valve attached to a frame of sufficient rigidity located at the SSFCE 300D exterior side port and or further located along or at the end of the exterior channel or tube assemblage. A further variation might incorporate on the exterior side of the gland interface with said slits a number of strips of a lesser tension or more elastic yielding gland material of sufficient width to overlap and cover the slits further disallowing the ingress of fluid from exterior to the interior of the gland thereby creating a form of a check valve.

The embodiment might further include and is not limited to the number of ports, placement or orientation around or within the perimeter of SSFCE Segment 300D.

Figure 4A:
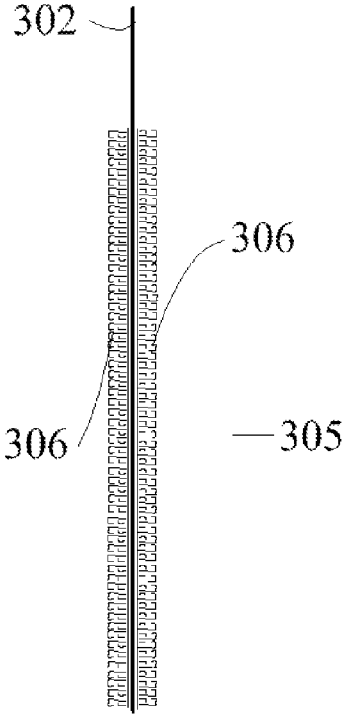

FIG. 4 comprises FIGS. 4A-4F, and shows detailed views of various hook-and-loop connections between segments. FIG. 4A is a side view of I-shaped hook flap 305 of a first embodiment of the connection, while FIG. 4B is a side view of V-shaped loop flaps 303. Hook flap 305 has hook material 306 disposed on both sides. Loop flaps 303 have loop material 304 disposed on the inside surfaces. In use, hook flap 305 is inserted between loop flaps 303 and hook material 306 engages loop material 304. Water must follow a circuitous path in order to leak though the connection thus formed.

In one preferred embodiment, loop material 304 is disposed at the top of segment 300 and hook material 306 is disposed at the bottom of segment 300, as this configuration has been found to permit the least amount of leakage. With the oil and gas migrating upward there is only an upward shear, with downward travel essentially non-existent.

Figure 4D:
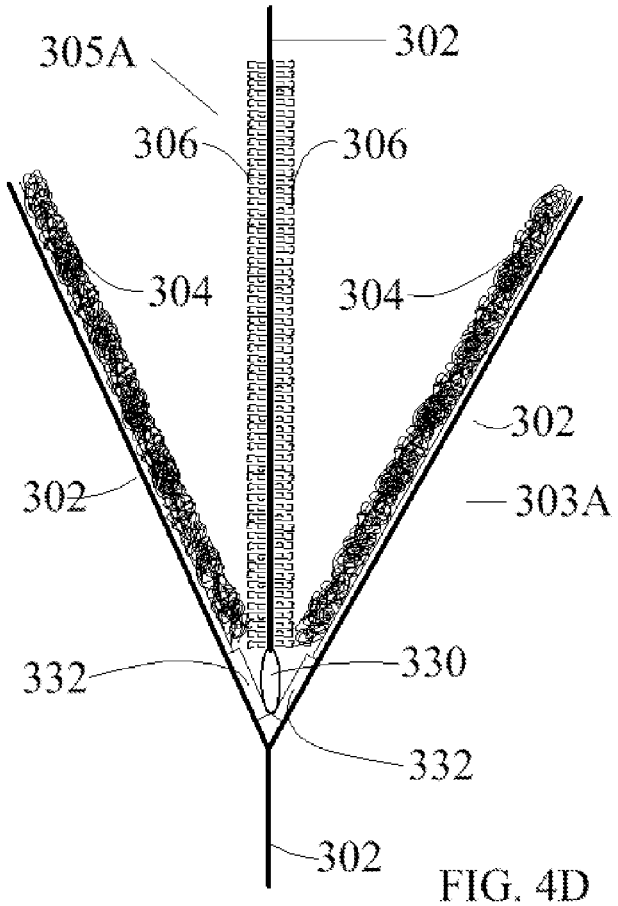
Figure 4C:
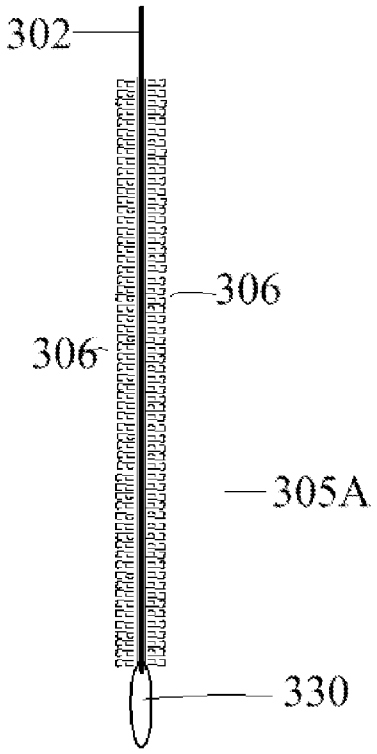

FIGS. 4C and 4D show a second embodiment of a hook-and-loop connection similar to that shown in FIGS. 4A and 4B, but wherein loop flaps 303A and hook flap 305A further comprise membrane materials 330 and 332 that provide a barrier that is compressed by the adjacent hook and loop material providing an enhanced liquid and gas seal. Interior membrane 330 might consist of a pliable elongated silicon bead/tubular member, while exterior membrane 332 might consist of a pliable rectangular silicone strip member.

Figure 4F:
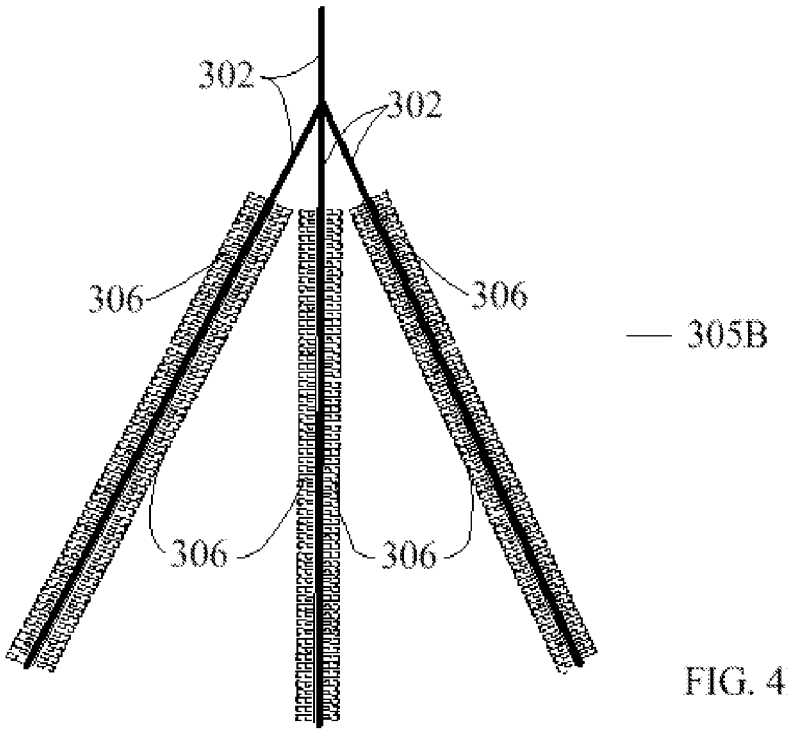
Figure 4E:
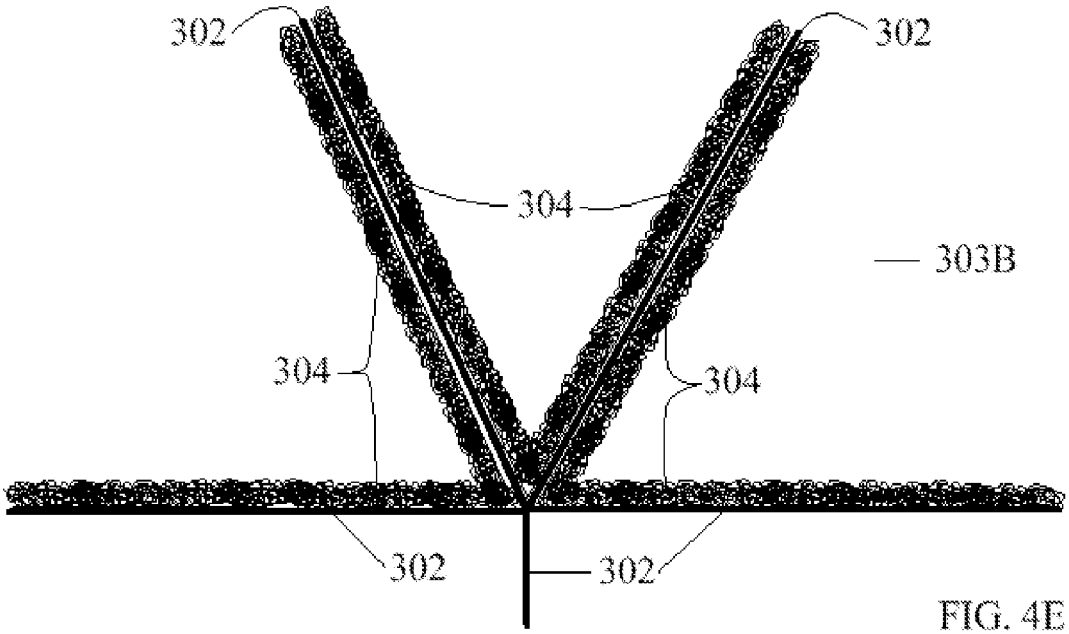

FIGS. 4E and 4F show a third embodiment of a hook-and-loop connection. Loop flaps 303B form a V-shape having loop material disposed on all four sides. Hook flaps 305B form a W-shape having hook material on all six surfaces. Engaging flaps 303B and 305B thus forces water to follow an even more circuitous path in order to leak through this connection. Those skilled in the art will appreciate various other configurations of hook flaps 305 and loop flaps 303 that could form similar connections between SSFCE 502 segments 300.

Figures 5A, 5B:
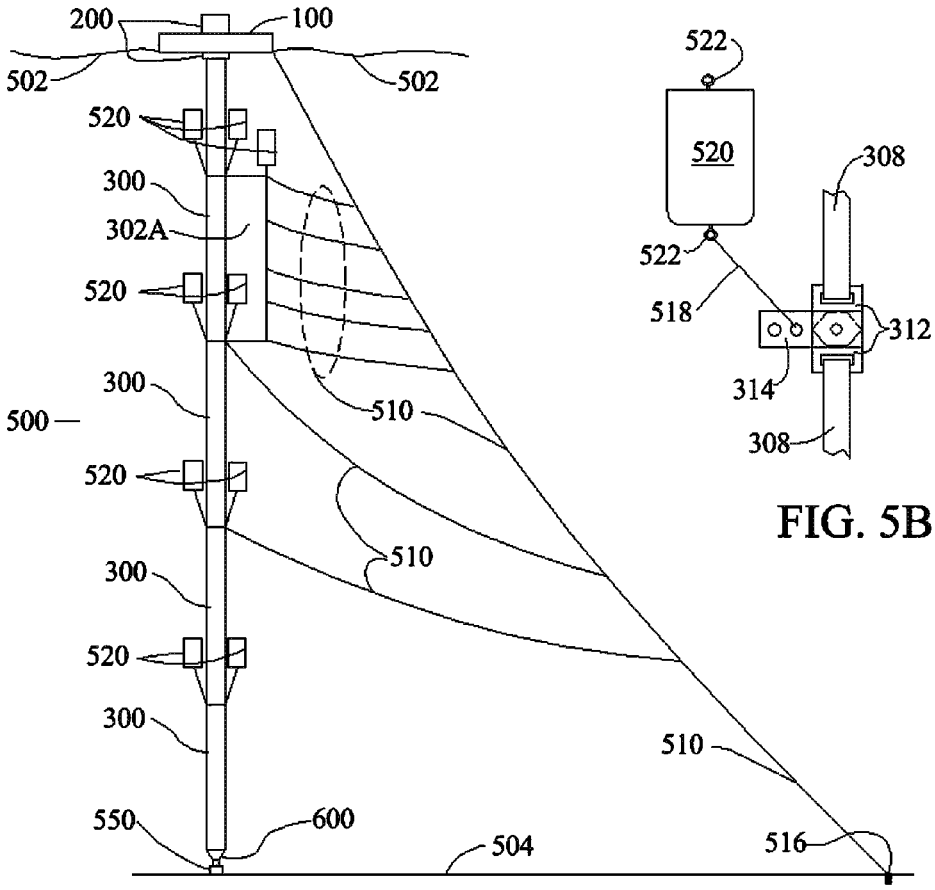
FIGS. 5A and 5B illustrate an example of a deployment configuration of the SSFCE.

FIG. 5 comprises FIGS. 5A and 5B which illustrate a deployment configuration of SSFCE 500. FIG. 5 shows how SSFCE 500 connects a hydrocarbon leak to floating platform 100 Rigid Enclosure 200. SSCFE 500 is a self-supporting flexible containment enclosure providing the conveyance method between subsea terminator assembly 600 or canopy terminator 300C and floating platform 100 at sea surface 502. There may be other variations and numbers of SSFCE subsea terminators connected to the SSFCE 500.

FIG. 5A shows a side view of the deployment. FIG. 5B shows the connection between a PONBAD and a strap termination point.

FIG. 5A shows an example of an SSFCE 500 having five SSFCE segments 300 connected in a manner such as those shown in FIG. 4 in order to form a 2500 foot (in this example) tube to direct a hydrocarbon leak 550 from the sea floor 504 (or other leak source) to floating platform 100 rigid enclosure 200, where gaseous and liquid products are separated and directed as required. In general, floating platform 100 is located at the waterline 500, though it may be semi-submerged when necessary. SSFCE 500 may be connected at seafloor 504 via a compromised emissions terminator interface such as subsea terminator interface assembly 600 shown in FIG. 6 or Canopy Terminator 300C shown in FIG. 7C. Subsea buoys 520 are attached (for example) at terminators 314 between segments 300. Various mooring lines 510 stabilize SSFCE 502 and attach to anchorage point(s) 516.

Other rode mooring or structural support points (not shown) may be attached as well. e.g. a Floating Platform Storage and Offloading (FPSO) vessel, Floating Storage and Offloading (FSO) Vessel, Drill Rig, or other structures like a Catenary Anchor Leg Mooring (CALM) buoy system.

Any entrapped air in SSFCE 500 during the deployment rises to the surface, leaving SSFCE 500 essentially collapsed and ready to engage the containment of the compromised emissions after it is partially filled with seawater.

FIG. 5B shows an example of how subsea buoys 520 are attached to connection points 314 via tethered cable connection lanyards 518 attached at eyehooks 522. The purpose of subsea buoys 520 is to create neutral or slightly positive buoyancy with respect to final anticipated loads being applied.

Subsea buoys 520 might comprise PONBADs—Positive Offset Neutral Buoyancy Attachment Devices, formed, for example, of Syntactic Foam. Different sizes and densities of material are chosen according to the desired outcome. PONBAD performance may also be fine tuned by the additional or subtractive application of the desired buoyancy equivalent offset weight using removable or attachable modules/members.

FIG. 6 comprises FIGS. 6A, 6B, 6C, and 6D, illustrates subsea terminator interface assembly 600 which connects between SSFCE 500 and leak sources 550. Interface assembly 600 comprises frustum panel enclosure section 605 and terminator section 625, connected via connector plate 616. Frustum panel enclosure section 605 comprises panels 302, support straps 308 and eyelets 310 constructed in a frustum shape and is part of and transitions the terminator to SSFCE 500.

Figure 6C:
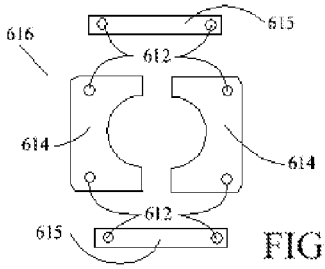
FIGS. 6A, 6B, 6C, and 6D illustrate connections between the SSFCE and leak sources.
Figure 6B:
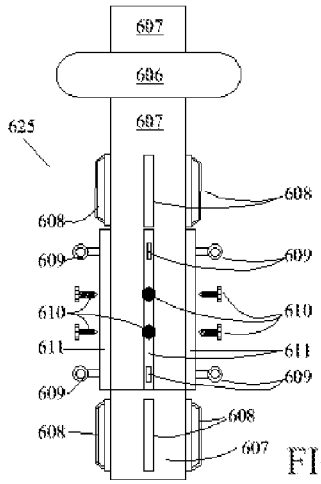
Figure 6A:
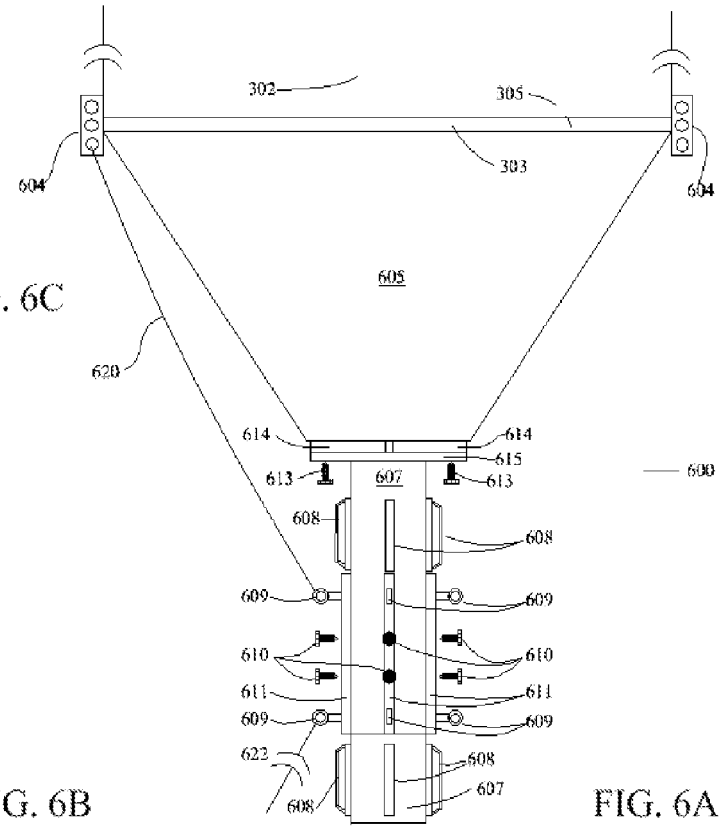

One example of a preferred embodiment of a subsea terminator interface assembly 600 interfacing with a compromised well-head or Blow out preventer BOP (not shown) is illustrated in FIG. 6A. The wellhead or BOP riser assembly is cut off, leaving a short riser stub. The operator 958 places the lower conduit section 607 over the stub using handles 608, and secures lower conduit section 607 by tightening the tapered pointed set bolts 610 onto the riser stub section.

FIG. 6B is a side view of terminator section 625. Terminator plate 606, lower conduit section 607, handles 608, eyebolts 609, tapered pointed set bolts 610 and bolt strip 611 form terminator section 625. FIG. 6C is a top view of connector plate 616, comprising split plates 614 and compression straps 615, forming mounting positions 612. A variation on terminator section 625 might include a tapered annulus within the ingress end of lower conduit section 607. A further variation on terminator section 625 might include a lower flange at the lower conduit section 607 ingress to accommodate the attachment of other flanged connections for termination to various pipe diameters and geometry using reducers or other mechanically attached interfaces.

Subsea terminator interface assembly 600 is assembled by lowering terminator section 625 through frustum panel enclosure section 605 until panel terminator plate 606 is blocked by the narrower opening formed at the apex of lower Frustum panel enclosure section 605, such that the attachment of split plates 614 and compression straps 615 secure Frustum panel enclosure section 605 to the lower portion of panel terminator plate 606.

Compression straps 615 with Split plates 614 form a seal with panel terminator plate 606 against the lower surface Panel terminator plate of 606. Fasteners 613 attach connector plate 616 to enclosure section 605 and terminator plate 606. Terminator plate 606 is smooth with rounded edges to limit wear and chaffing.

Upper eyebolts 609 provide for the attachment of guy lines 620 between terminator interface assembly 600 and termination points 604 to SSFCE 502, to reduce strain between lower conduit section 607 and panel enclosure section 605. Lower section eye bolts 609 provide for the attachment of safety or backup guy lines 622 between the lower conduit section 607 and the object that the terminator is connected to, such as a BOP riser stub (not shown) or other structures, and may reinforce and reduce the vertical shear load on the tapered pointed set bolts 610. In general, subsea interface terminator assembly 600 would be constructed topside and would be the first to be deployed in the succession of components comprising SSFCE 500.

Figure 6D:
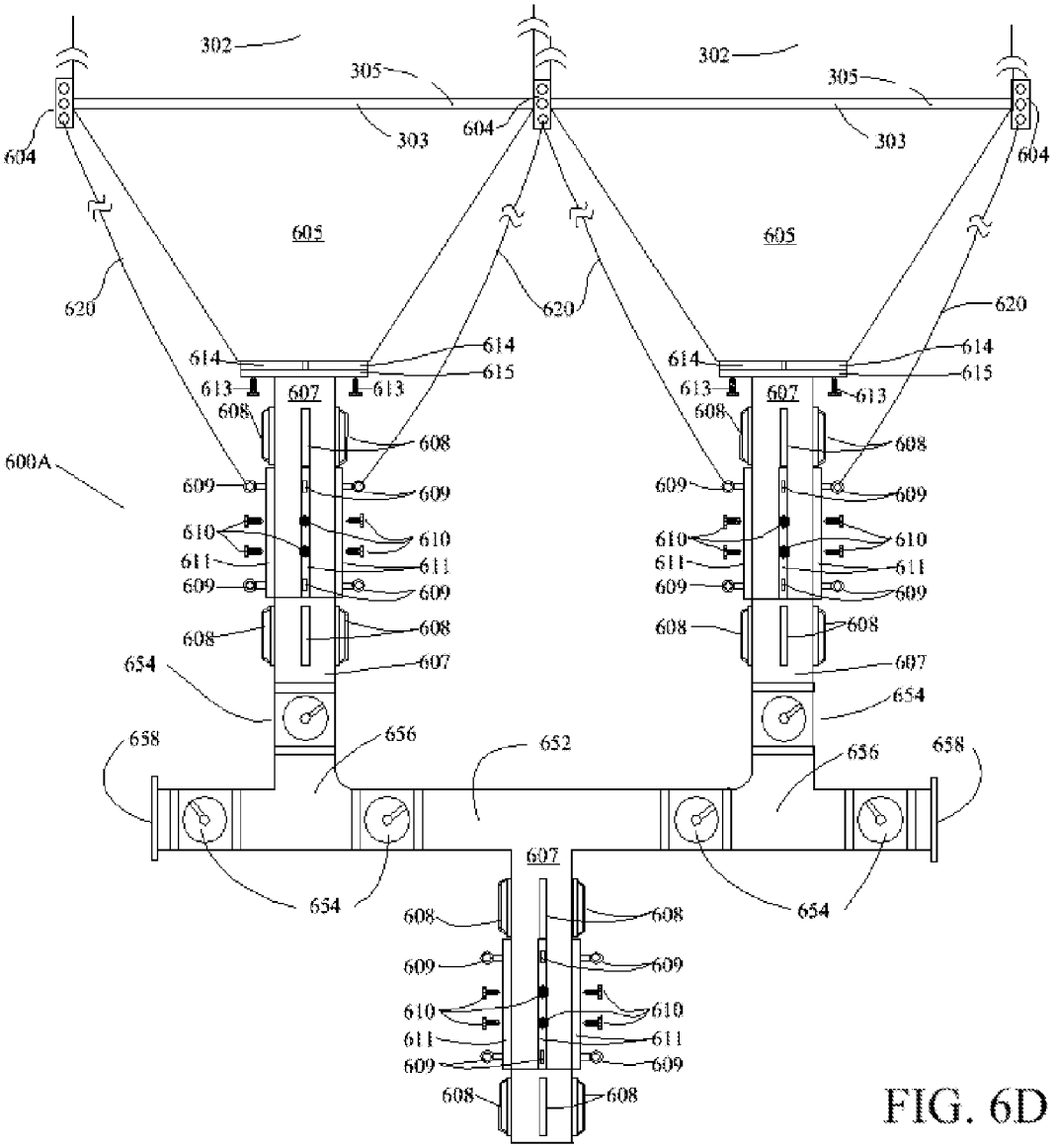

FIG. 6D is a side view of a dual subsea terminator interface assembly 600A, configured to connect to dual SSFCE segments 300. It basically comprises two subsea terminator interfaces similar to interfaces 600 connected by horizontal manifold tee section 652 to a terminator section 625. Valves 654 control the flow of leaking hydrocarbons to SSFCE 502 (via enclosure sections 605 and conduit sections 607) and to flanged ports 658. This arrangement might be used to direct the compromised emissions to more than one Floating Platform 100. The flanged ports 658 provide connections to jump line conduits or hose to introduce product into other nearby distribution systems or may be used in reverse to introduce materials into the SSFCE system.

A variation on subsea terminator 600 might have a number of multiple size flanged ports, valves and manifolds connected to a lower single section of conduit section 607.

Optionally, the Process control system 950 may have full duplex communication capabilities and power extended to further monitor characteristics of the flow emanating from the source, such as temperature, flow rates, material content, etc.

A further variation on the Terminator section 625 and Frustum panel enclosure section 605 might include items such as attached instrumentation 780 or sensors 750 to measure internal and external temperature, emission flow rate and or operate valves by motorized actuators.

Figure 7A:
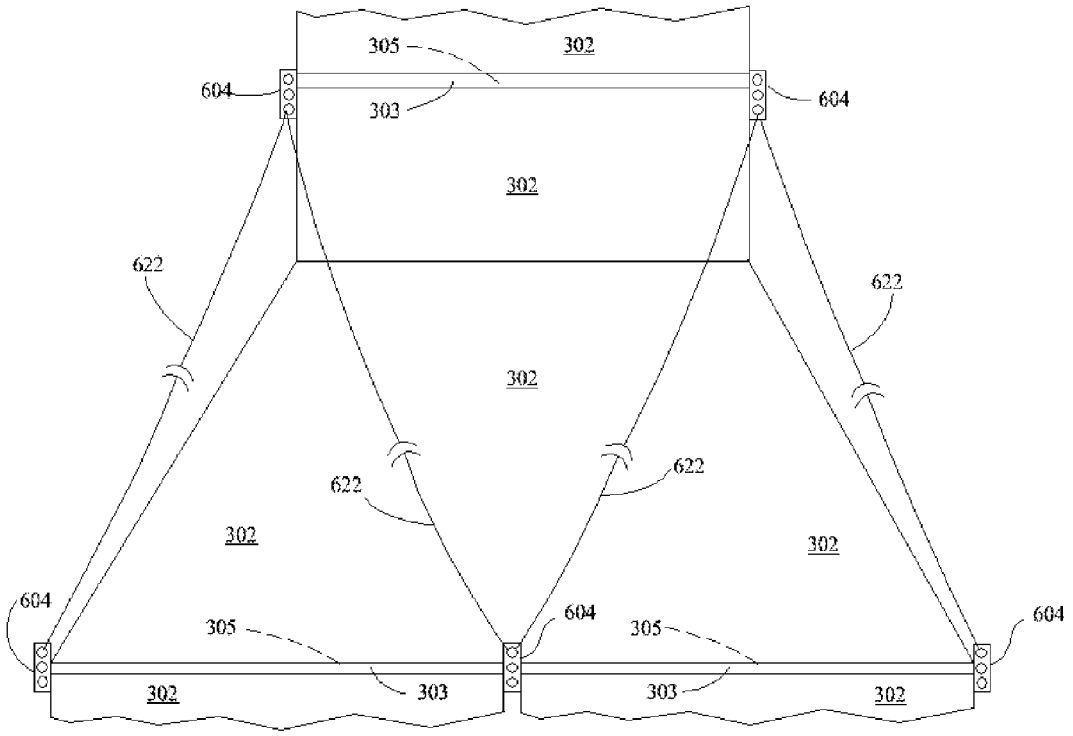
FIGS. 7A and 7B illustrate an SSFCE tee assembly 300B.
Figure 7B:
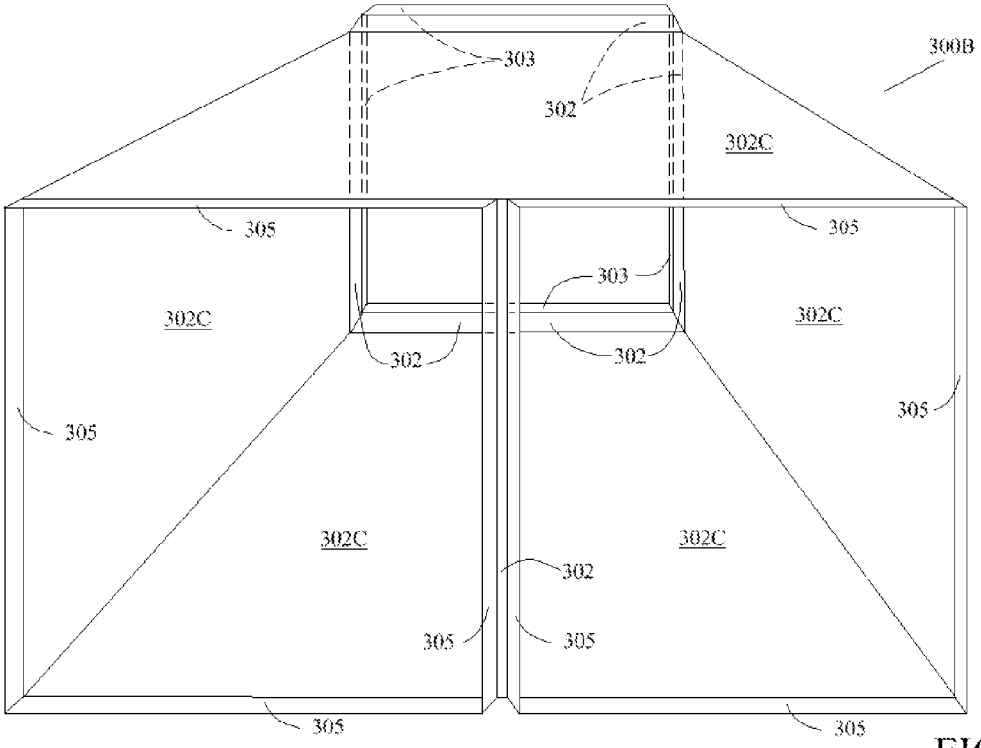
Figures 7C, 7D:
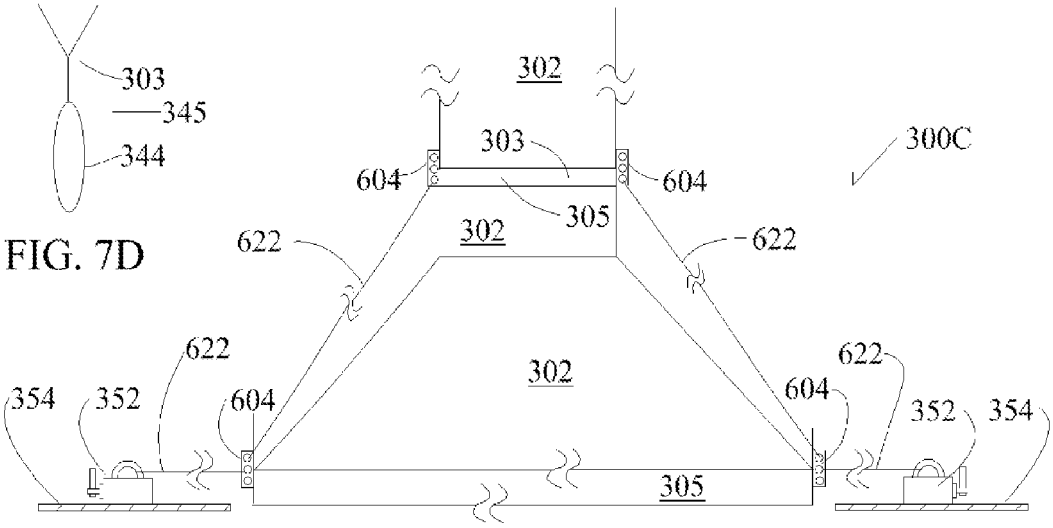
FIG. 7C illustrates an outer side view of a canopy terminator assembly.
FIG. 7D illustrates a side view of a skirt assembly.

FIG. 7 comprises FIGS. 7A, 7B and 7C.

FIG. 7A is an external side view of SSFCE tee assembly 300B.

FIGS. 7A, 7B illustrate use of an SSFCE tee assembly 300B. FIG. 7A is an external side view of assembly 300B with Frustum panel segment 302C that allow assembly 300B to attach to dual SSFCE segments 300. Frustum Panel Segment 302C is shaped like a clipped pyramid or trapezoid. Guy Lines 622 are broken to illustrate that in a preferred embodiment these would be of a variable length, preferably being shorter than the mechanical length or height of the 300B enclosure, thus reducing the strain or tension forces acting upon 300B and inherently providing some slack or a ruffle/ripple/frill/gathering for tee assembly 300B. The other broken lines for the fabric panels are to indicate variability in size as well. Tee assembly 300B includes connection portions at the top and bottom (such as loop flap 303 and hook flap 305).

FIG. 7B is a bottom isometric view of tee assembly 300B with Guy lines 622 removed for clarity. It shows how liquid and gaseous material flows from more than one SSFCE Segment 300 and combine to form one flow within standard SSFCE segment 300 above. Tee assembly 300B might be employed in an opposite configuration to divide into separate flows.

SSFCE Tee assembly 300B might further include additional internal arrangements of panels such as louvers and or meshed panels for enhanced directional control of the individual or combined components comprising the hydrocarbon material flow.

FIG. 7C shows an outer side view of a single Canopy terminator 300C that might be used to cover, straddle, envelop or tent a subsea floor fissure, a horizontal pipe-transport leaking assemblage or other leak source 550. A Canopy terminator 300C might be fabricated to various sizes to cover areas that show evidence of leaks. It may have one or more panels or frustums that may be symmetrical or asymmetrical in geometry.

Canopy terminator 300C might also have attached to its lower perimeter Hook flaps 305 skirt assembly 345 as shown in side view in FIG. 7D. Skirt assembly 345 is attached with Loop flaps 303 and might contain within the formed lateral Sleeve 344 a suitable weighted material like sand, gravel or chain to ensure the Canopy terminator 300C sufficiently interfaces with seafloor bottom 504.

Switchable Magnet 352 or other connecting or clamping device attaches to weighted anchoring object 354 (such as a mass of Ferrous material) or other structures to provide anchorage upon seafloor surface 504. Anchoring object 354 may be embedded into the seafloor surface with engagement protrusions.

If a number of deployed canopy terminators 300C are combined, a collection method can be employed for gross widespread emissions of gaseous and liquid hydrocarbons in thermally unstable seafloors or with seafloor emissions emanating from unstable or underlying fractured strata below the seafloor. A blown out or compromised well casing or bore hole below the seabed might also cause subsea floor fissures. Combining multiple canopy terminators 300C each connected to SSFCE 300 segments and connected using one or more SSFCE Tee Assemblies 300B further directed to a single SSFCE 300 Segment forms a multi-segmented complete SSFCE 500 system.

Figure 8A:
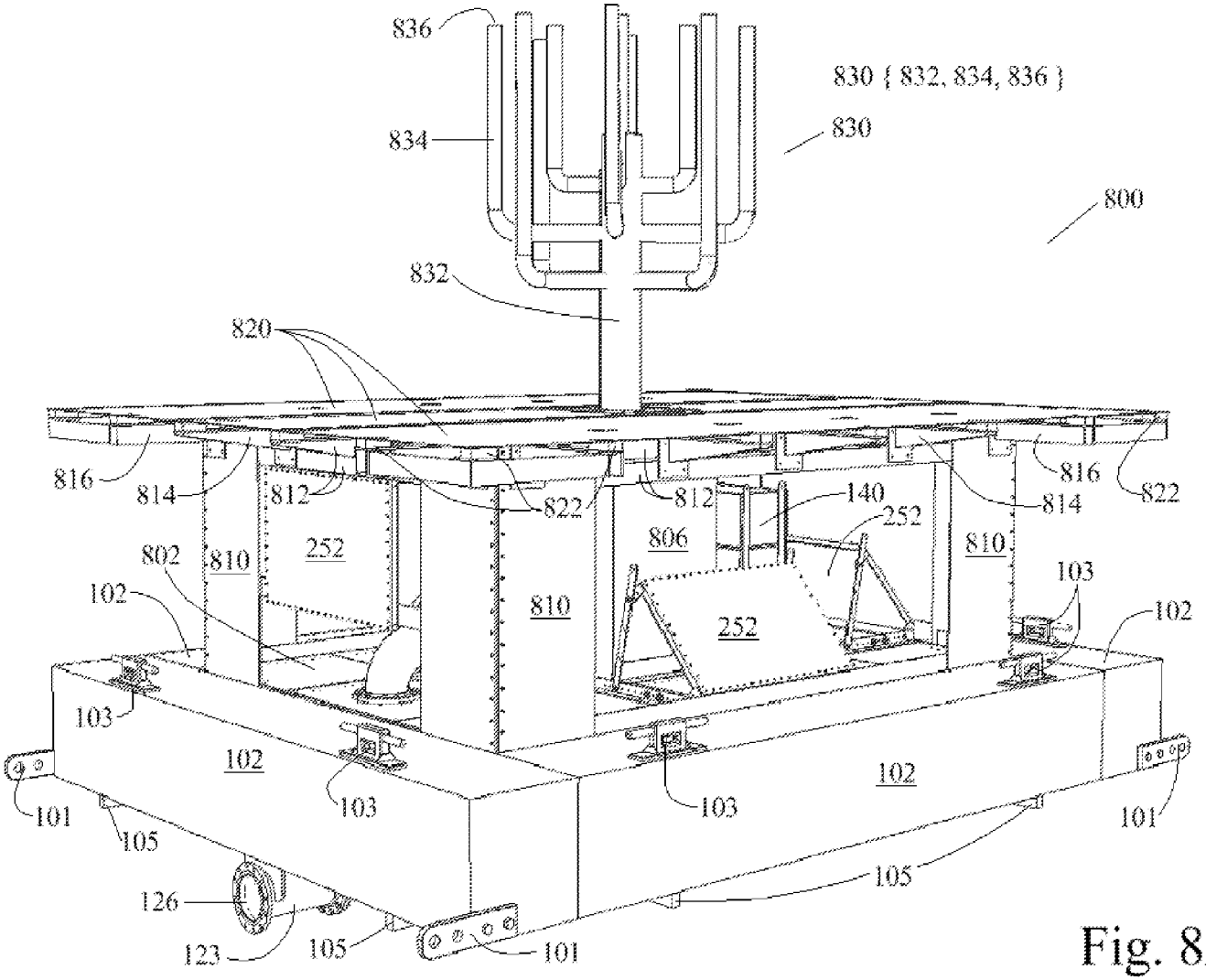
FIGS. 8A-8E illustrate a floating flare assembly according to the present invention.
Figure 8B:
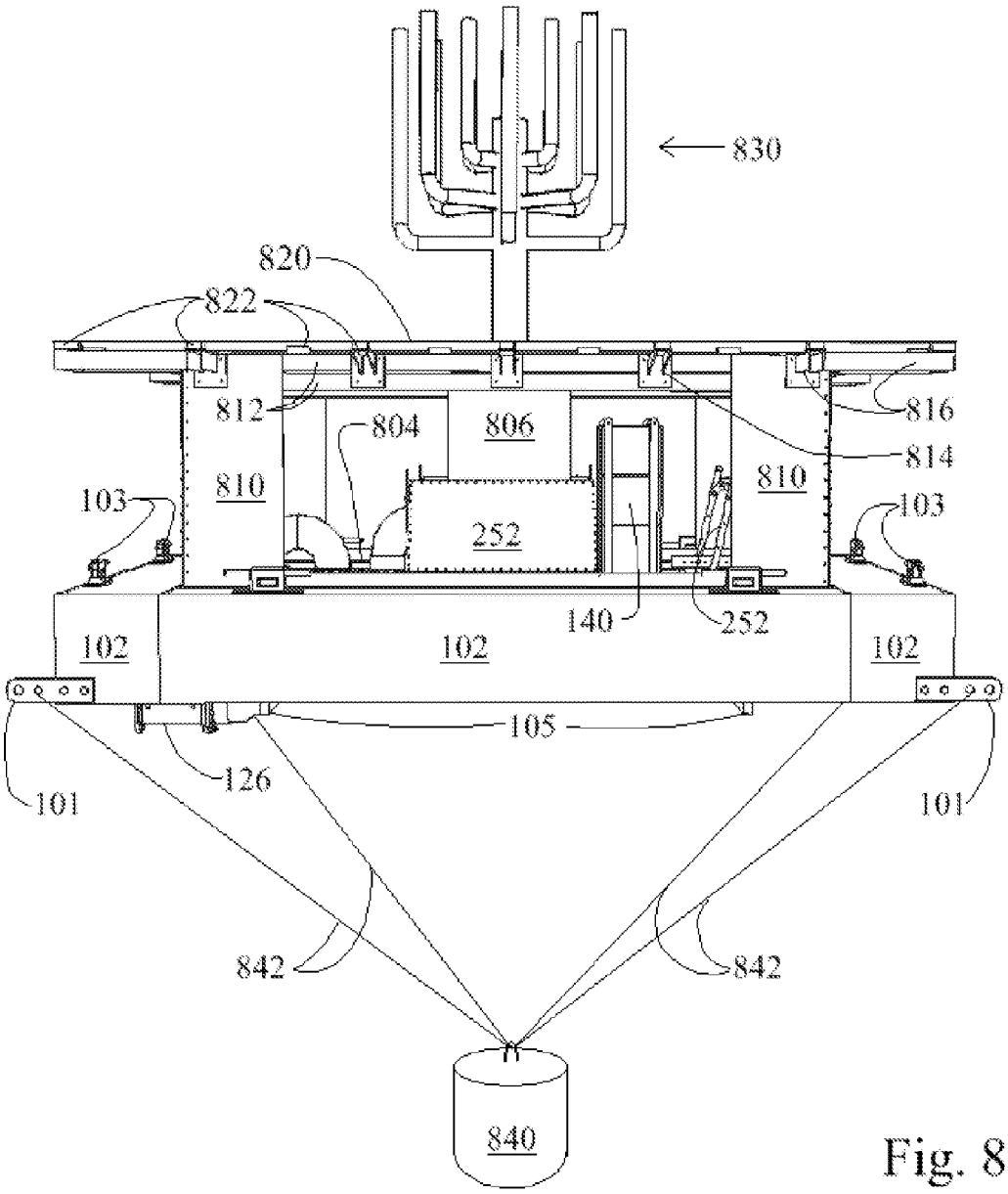
Figure 8C:
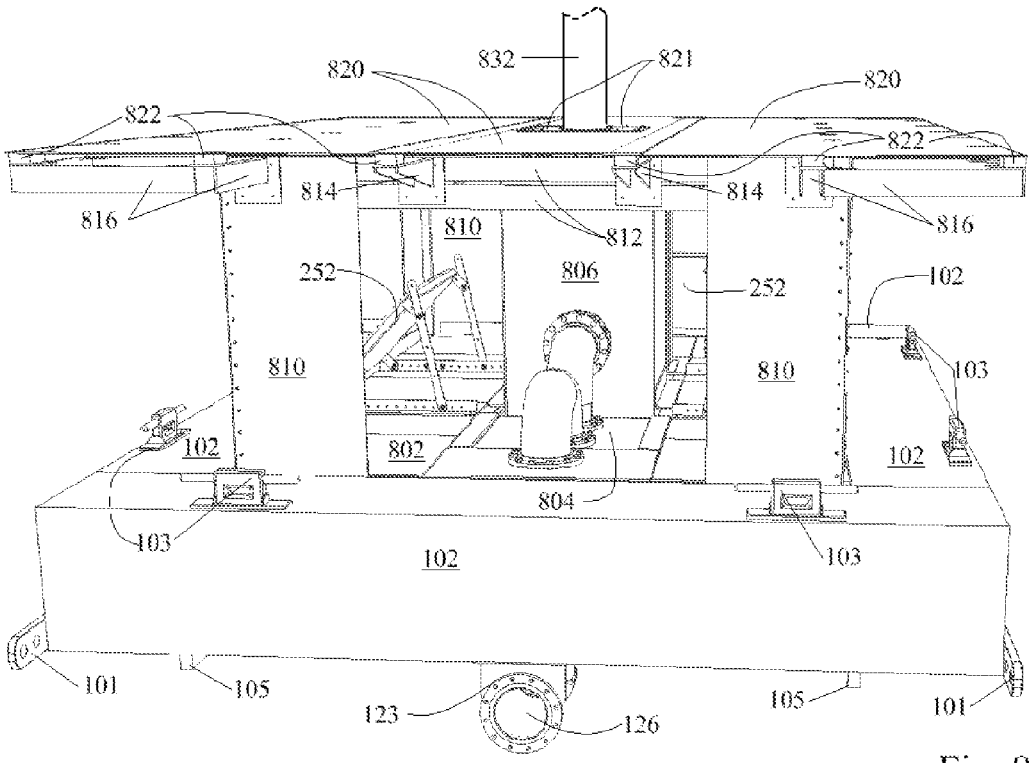
Figure 8D:
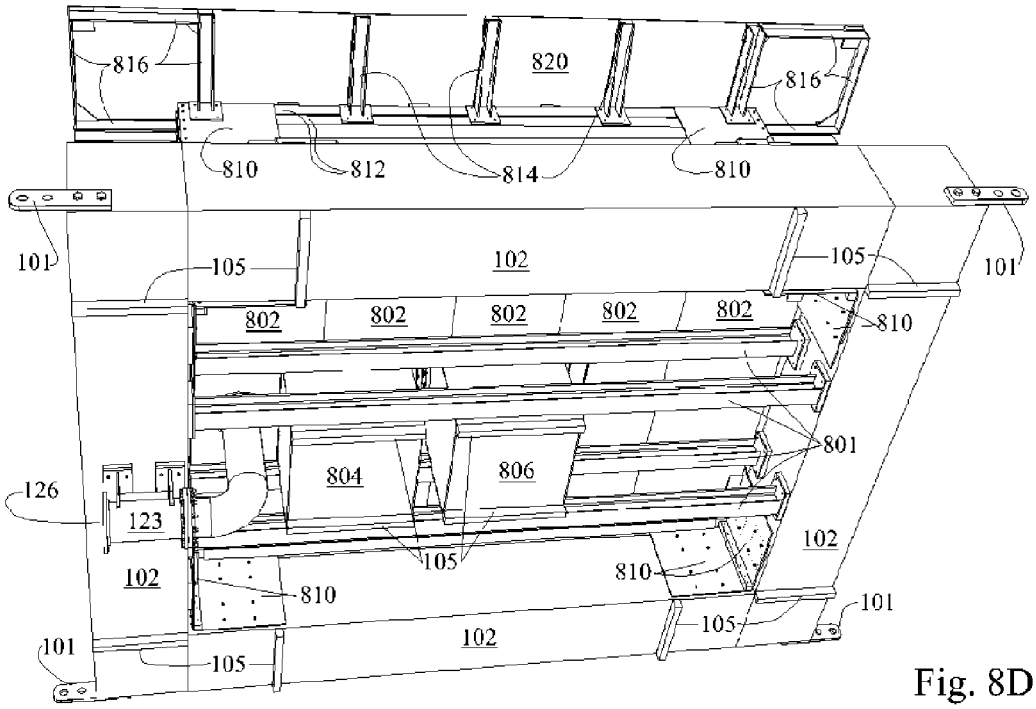
Figure 8E:
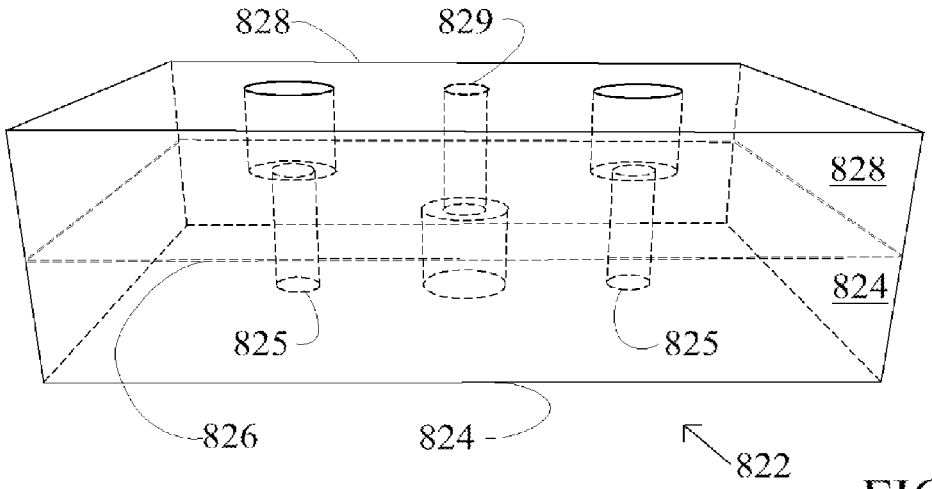

FIG. 8 comprises FIGS. 8A-8E and illustrates an autonomously operated floating flare platform according to the present invention. FIG. 8A is an isometric view of floating flare platform 800, FIG. 8B is a side view of floating flare platform 800, FIG. 8C is a stern side isometric view of floating flare platform 800, FIG. 8D is a bottom isometric view of the floating flare assembly and FIG. 8E is a detailed hidden isometric view of thermal blocks 822 used to isolate the radiant heat conducted from the radiant panels 820 on floating flare platform 800. Floating flare platform 800 is used to burn off gaseous hydrocarbons delivered to it from floating platform 100. The embodiment shown here is located on a separate platform, and the gaseous hydrocarbons provided via a tethered Flexible marine hose 701 (not shown) or the like.

Floating flare platform 800 provides for an integrated apparatus to flare (burn off) gaseous emissions from floating platform 100 that are directed from gaseous product ports 126 (See FIG. 1) via tethered Flexible marine hose 701 (not shown) to gaseous product port 126 on floating flare platform 800. Flexible marine hose 701 might comprise a flexible marine hose suitable for transporting liquid and gaseous hydrocarbon products. Flexible marine hose 701 may also have attached to it "winker lights" (not shown) for collision avoidance and other transport lines (not shown) to convey liquid, air, gas, electricity, and/or means for electrically grounding the conduit to minimize static and to provide lightning protection. A preferred Flexible marine hose 701 would have a grounding conductor included as part of the construction from the manufacturer.

Floating flare platform 800 may be structured similarly to floating platform 100 in FIG. 1, including flotation vessels 102 for supporting the structure, mooring points 101, support blocks 105, cleats 103, etc. Solar panels 252 may be provided to generate electricity. The vertically suspended Solar panel 252 in FIG. 8A has been removed in FIG. 8C for clarity. In this embodiment Floating flare platform 800 obtains its power for operation from a plurality of Deep discharge batteries 781 (not shown) charged by Watertight solar panels 252. This powers condensate collection enclosure 804 chemical pump 805 (not shown) to remove accumulated condensate liquid for injection into the flare assembly gas stream, flashback enclosure 806 water pump 807 (not shown), and including such items (not shown) as sensors 750, liquid level detectors 753 and 767 (not shown), solenoid operated valves 787 (not shown), process control system computer 850 (not shown), ground radio digital link transceivers 980 (not shown) for communications to and from Floating platform 100, and a flare ignition controller system 852 (not shown) comprising a Flare ignition Controller 852, Flare igniter 854, Flare ignition fuel 856 and Flare ignition purge gas 858. Condensate collection enclosure 804 is also known as a "knockout" box or drum used in the collection of any condensates from the gas stream.

Structurally speaking, Vertical corner support assemblies 810 are secured to an arrangement of Flotation vessels 102. They form inside corners to secure Upper horizontal beam assembly 812, which is constructed in a horizontal framework as seen in FIGS. 8A, 8B, 8C, and 8D. Exterior horizontal single support assembly 814 and Exterior horizontal corner support assembly 816 are secured to Upper horizontal beam assembly 812. Radiant panels 820 mount Thermal blocks 822 with fasteners and isolate them from assemblies 812, 814 and 816. FIG. 8C illustrates two bolted split plates 821 attached to radiant panel 820 surrounding the lower portion of flare barrel 832, providing access to flare barrel 832 flange connection (not shown) to Flashback enclosure 806.

Flare assembly 830 comprises Barrel 832, Arms 834 and Orifice 836 and is secured to the top of Flashback enclosure 806 with a flanged pipe connection (not shown). Also not shown in FIG. 8A are examples of orifice 836 tip outlets that may be used. Various other designs might be supplied by different manufacturers. Flashback enclosure 806 is secured by flanges at two locations at the bottom of Upper horizontal structural beam assembly 812. Flashback enclosure 806 is also secured to Lower structural beam assembly 801 by flanges at four locations, as shown in FIGS. 8C, and 8D.

Lower horizontal structural beam assemblies 801 are also secured to the Flotation vessels 102 and secure Floating flare upper deck 802, Condensate collection enclosure 804, Flashback enclosure 806, Watertight solar panels 252, Watertight equipment enclosures 140, fuel gas tanks (not shown) for the ignition of flare assembly 830, and Purge gas tanks (not shown) for purging explosive gas from Flare assembly 830.

Flare ignition system 852 is conventional and is not shown or described in detail. Briefly, a flare igniter 854 is typically secured to Flare assembly 830, and is fueled by a flare ignition fuel 856 tank containing fuel such as propane or LNG and operated by a flare ignition controller 852. The flare ignition purge gas 858 tank contains pressurized nitrogen or other like purge gas and is operated by the flare ignition controller 852, which is controlled by the Process Control System 850 shown in FIG. 12.

Other conventional equipment 780 and sensors 750 might further include components such as chemical pumps, water pumps, liquid level sensors, Ground radio data link 980 providing communication for control options along with operational information such as pressure levels, flow rates, temperatures, etc.

Floating flare platform 800 supports Upper deck 802, upright assembly 810, Condensate collection enclosure 804, and flashback enclosure 806. Vertical corner support assembly 810, supports Flare assembly 830 and Radiant panels 820 via exterior single support assemblies 814 and exterior corner support assemblies 816.

FIG. 8B shows suspended counterweight 840 attached to platform 800 via cables 842. The purpose of the counterweight is to assist in the reduction of vessel heave, pitch and roll by damping platform 800 motion, thus improving the platform's overall stability.

Thermal blocks 822 isolate conductive heat from Radiant panels, preventing heat radiated from the Flare Assembly from affecting Floating flare platform 800. These are better shown in FIG. 8E.

FIG. 8E shows a detailed view of thermal blocks 822. Each thermal block 822 is preferably formed of a thermal block base material 824 bonded by High temperature and high strength bonding material 826 to Thermal block insulator material 828.

Thermal blocks 822 form base material Countersunk fastener holes for insulating material 829 for attaching thermal blocks 822 to radiant panels 820. Thermal blocks 822 also form Countersunk fastener holes for base material 825 for attaching Thermal blocks 822 to upper horizontal structural beam assembly 812, exterior single support assemblies 814, and exterior corner support assemblies 816. Thermal block insulator material 828 might consist of high temperature ceramic composite material.

In this embodiment radiant panels 820 might be constructed of stainless steel panels with associated stainless steel fasteners to withstand the radiant energy and shield the vessel and structure below. Radiant panels 820 might further include an insulative material secured to the underside to further reduce downwardly emanating radiant energy.

Watertight equipment enclosures 140 are provided to enclose and safeguard various equipment (not shown). For example, Floating flare platform 800 preferably includes a flare ignition controller system 852 as described above located within a watertight equipment enclosure 140. Other watertight equipment enclosures 140 might contain equipment 780 and sensors 750 such as deep discharge batteries 781, a charge controller and regulator 782, the Process Control System 850 shown in FIG. 12, Ground radio data link 980, a condensate collection enclosure chemical pump 805, a flashback seal enclosure water pump 807, multiple liquid level sensors 750 and other sensors 750, and various other process equipment 780.

Floating Flare 800 Process Control System 850 (see FIG. 11) provides for the autonomous operation and monitoring of activities such as the flare ignition controller system 852, operation of solenoid valves 787 for flare ignition fuel 856 and purge gas 858, and other process equipment described above. Floating Flare 800 obtains its power for operation from batteries 781 charged by the Watertight solar panels 252.

FIG. 9 illustrates a portion of the buoyancy control logic for floating platform 100. FIG. 9 is primarily a logic drawing, but it does include a cutaway side view of one flotation vessel 102 to illustrate the submergence and surfacing processes. The components that comprise Buoyancy control system 935 is a part of operations performed by the Process Control System 950.

Flotation vessel 102 in FIG. 9 includes two ports: Water port 908 (along bottom interior surface 904) having a short interior vertical conduit orientated toward the bottom; and Air port 906 (along top interior surface 902) having a short interior vertical conduit orientated toward the top. Both ports 906, 908 are located on the exterior vertical surface of Flotation vessel 102 facing the interior perimeter of Flotation vessels 102. Electronic liquid level sensor 920 might be located on the same surface as Air port 906 and Water port 908.

In the preferred embodiment, there are four Water pumps 918, acting in two pairs operating as two pumps in parallel. One pair of pumps provides operation for an opposing pair of Flotation vessels 102, while the second pair provides operation for the adjacent opposing pair of Flotation vessels 102. This arrangement provides for a uniform and symmetrical distribution of introduced liquid ballast and additionally provides redundancy and increased reliability. This preferred pairing arrangement is also used to provide and control air in a uniform and symmetrical distribution which again provides redundancy and increased reliability. All hose lengths are preferably of equal diameter and length, resulting in equivalent flow rates and pressure drops for the corresponding liquid and air media types.

This arrangement may be simplified to one pair of water pumps 918 in parallel providing control to Aft position 100A and Bow position 100B, while the other pair in parallel provides control to Port position 100P and Starboard position 100S as shown in FIG. 1A.

Solenoid valves 922, 924, 926, and 928 are normally closed with the logic condition being 0 or not enabled.

Buoyancy system 935 (in turn controlled by Process Control System 950) controls the process of surfacing (or decreasing the draft) by enabling logic function 921 (SI) by simultaneous activation of solenoid valves 922 and 924, egressing ballast water and displacing it with pressurized air to achieve the level of buoyancy required. Solenoid valve 922 is activated, permitting compressed air from compressed air tank array 130 to flow into regulator 132 and into flotation vessel 102 Air port 906. Solenoid valve 924 opens to allow water to "blow out" ballast through Ballast blow out port and inline check valve 912 from Water port 908. When the desired depth is achieved, logic 921 deactivates and solenoid valves 922, 924 close.

The action and process of submergence (or increasing the draft) is performed by enabling logic function 925 (S2) to cause simultaneous activation of solenoid valves 926, 928 to displace air within Flotation vessel 102 and to replace the air with the ballast water. Solenoid valve 926 opens air vent outlet 910 to allow the air to escape from Air port 906. Solenoid valve 928 controls pump 918 which causes inflow through gross/fine filter water inlet 914 to Water port 908.

Electronic liquid level sensor 920 provides a liquid level measurement inside each buoyancy vessel 102. Other sensors (not shown) provide data representing the actual draft or depth of Floating platform 100. When the desired depth (or draft) is achieved logic condition 925 is disabled and valves 926 and 928 are deactivated or closed.

In a preferred embodiment ports 906 and 908 are mounted within the interior perimeter of Flotation vessels 102 and adjacent to Rigid enclosure 200 (e.g. air port 906 on top interior vertical surface 902 and waterport 908 on bottom interior vertical surface 904). Another port placement method (not shown) mounts both ports to gasketed bolt on flanges located on flotation vessel 102, enabling access to both sides of the two ports.

In a preferred embodiment, flotation vessel 102 may have a number of transverse baffles or surge plates installed (not shown) to minimize longitudinal surge and slosh of ballast water due to ocean wave action. Sacrificial anodes (not shown) may be provided for corrosion control.

The achieved draft or resultant depth of floating platform 100 is based on many factors such as: volume and mass of the ballast seawater 503 contained in flotation vessel 102; total mass of floating platform 100; volume of crude oil 564 content within the upper SSFCE segment 300 and its potentially variable density value; volume of gaseous product 566 within Rigid enclosure 200 and the upper SSFCE segment 300; the vertical load of the total SSFCE assembly 500 as measured by strain gauges (not shown); horizontal and vertical loading of SSFCE assembly 500 by undersea transverse current velocities; amount and degree of emulsified products 564 and 566 contained and affecting the overall buoyancy; weather characteristics; and Global Positioning Satellite GPS location deviation from the target.

These and other variables are one of the reasons for an advanced Process Control System 950 to monitor and adjust the dynamics of this invention. The complexity and number of variables under consideration is preferably addressed by an autonomous Process Control System 950 which also enables digital communication for remote monitoring and control by operators 958.

FIG. 10 shows a flow chart illustrating the product flow system 954 for both the gaseous hydrocarbon and liquid hydrocarbon material from origination to destination.

In one embodiment, SSFCE 500 has one input and one output. Floating platform 100 has multiple outputs, enabling flexibility and or changeouts in the presentation of product output for final disposition. For example, offloading liquid product requires time to disconnect and reconnect to tankers when vessels are changed out. Multiple liquid product ports reduce this time. To further extend the time required for product presentation to offload vessels, a number of conventional temporary storage Towable bladder bag 700 might be incorporated in the product flow configuration. This embodiment also supports routing the gaseous product to multiple outputs, for example to support two Floating flare platforms 800.

FIG. 11 is a block diagram showing a majority of the Process Control System 950 operations performed on the Floating Platform 100.

The operations performed start by loading and initializing the default program with initial parameters, enabling data logging; system functions, actuators and sensors are checked and communication links are established prior to starting operation. FIG. 11 illustrates a process flow of operations that are continuously monitored and adjusted as required.

To achieve control of Floating platform 100, Process Control System 950 makes use of the inputs from various sensors 750. Further the Process Control System 950 provides control functions to buoyancy control system 935, product flow system 954, and other equipment 780. Product flow system 954 includes equipment such as Valve assemblies 120, Other equipment 780 and sensors 750 might include various pumps, solenoid valves, solid state IGBT relays 783, voltage and current sensors 773, navigation aid lighting 255, other electronic equipment, liquid to air heat exchanger system 785, pulsed radar liquid level sensors 751, laser liquid level sensors 752, pressure sensors 768, etc. A number of Sensors 750 might typically be located within watertight sensor enclosures which may additionally include an internal Video Camera 788 with LED lighting 789. A number of sensors 750 preferably redundant are used, including pulsed radar liquid level sensor 751, laser liquid level transmitters 752 and pressure sensors 768 providing information to control the flow rates and volumes preferably by digital control valve actuators 122 in conjunction with the autonomous draft functionality of the platform.

Other sensors 750 preferably are incorporated in the Floating Platform 100 such as ultrasonic liquid flow sensor 765, an ultrasonic gas flow sensor 754, multipoint liquid level sensor switch 767, strain gauges 770, moisture detection sensors 775, temperature sensors 772, pressure sensors 768, pressure sensor switch 769, and photoelectric cell sensor 774. The Process Control System 950 additionally monitors, via sensors 750, such events as external wave height, periods and impingements, internal liquid level heights and periods, internal and external hydrostatic pressures, flow rates, buoyancy forces and the overall mass loading of the SSFCE 500, and GPS coordinates. Process Control Systems 950 autonomously performs specific functions based on continuously monitored sensor inputs and further communicates to a more specific and limited Process Control System 850 onboard the Floating flare platform 800 where additional parameters are monitored and functions performed.

Three related and important parameters are critical for sustained operation: (1) the need to establish, maintain and periodically adjust the Floating platforms 100 draft via buoyancy control system 935; (2) maintaining the gas flow and contained volume within the rigid enclosure via product flow system 954; and (3) maintaining the flow and contained volume of crude oil via product flow system 954.

As an example, the process control system might use a pulsed radar liquid level sensor 751 and laser liquid level sensor 752 in combination, measurements may be obtained of the surface height and depth of the accumulated liquid hydrocarbon emissions 564 within the upper portion of the SSFCE 500 structure in conjunction to the location of the respective sensors.

A pulsed radar liquid level sensor 751 will provide a distance value by the time measured to make a round trip of a reflected signal from a material having a significantly different dielectric constant than the medium it is transmitting thru. Seawater having a higher dielectric constant in the area of 60 to 80 will reflect the signal with a strong contrast compared to hydrocarbon products having a relatively low dielectric constant in the area of 4.0 and below with methane gas having a dielectric constant less than 2.0. The laser liquid level sensor 752 measures the round trip time when the laser beam is reflected from a liquid or solid surface. The sensors 751 and 752 may each be duplicated for redundancy and used for backup purposes and to also allow for averaging of the data provided.

Process Control System 950, along with power control equipment 780; is preferably located within Watertight Equipment Enclosures 140 and further includes items (not shown) such as a master process control system 950 computer, a redundant process computer, electronic modules 799 comprising for example, analog and digital input and output control modules, signal isolators, etc.; current sensors 773, solid state IGBT relays 783, a water to air heat exchanger 785, a sensor arrangement providing for a tri-axial accelerometer, rate gyro and magnetometer 771 measuring x-y-z acceleration, pitch, roll, yaw rate and magnetometer data and communication links comprising ground radio data link 980 and satellite data link 988. In a preferred embodiment of this invention, the Primary Process Control System 950 being the primary controller is located on board the Floating platform 100 while a secondary, smaller and more process specific Process Control System 850 illustrated in FIG. 12 is located on the Floating flare platform 800. Process Control System 950 may be operated autonomously and located on floating platform 100 in communication with floating flare platform 800, or may be operated in a remote location, or may be distributed among two or more of these locations.

In the preferred embodiment the remote Human Machine Interface HMI monitoring and control capability afforded to the Floating Platform 100 and Floating Flare Platform 800 is provided by a meshed digital communications link using ground radio data link 980 transceivers onboard both Floating Platform 100 and Floating Flare 800 enabling secure communication to operators 958, such as the local Deployment operations manager. Depending on the range, communication to these platforms may be from land, sea or air. Communication between the Floating Platform 100 and Floating Flare is of a minimal distance. Communication via the HMI interface is further enhanced by the use of Satellite data links 988 between the Floating Platform 100 and providing a redundant link to the Local Site Deployment operations manager while extending communication to Remote Spill Management Engineering and Regulators enabling information to be readily available for other concerned parties such as other government regulators, corporate office and engineering locations as illustrated in FIG. 15.

According to the present invention a Process Control System 950 provides autonomous monitoring and control performed in near real time better than the reaction times by a human operators reaction times is able to perform, while also enabling supervisory monitoring and control by a human operator 958 to remotely monitor and control the operation using a Human Machine Interface HMI via digital communication radio links that are accessible concurrently by ground radio and or satellite communication.

FIG. 12 is a block diagram showing a majority of the Process Control System 850 operations performed on the Floating Flare 800. The operations performed start by loading and initializing the default program with initial parameters, enabling data logging and establishing the communication link. The system checks the operational functions, pumps, valves, actuators and sensors and the process starts. Process Control System 850, along with other control equipment is preferably located within Watertight Equipment Enclosures 140. The Process Control System 850 monitors by sensors such values as gas pressure, liquid levels and temperatures to operate specific functions and communicates the operation and status via a communication link.

FIG. 13 illustrates an example of the fluid flow control portion of the control system.

The Process Control System 950 uses Programmable Logic Controllers PLC and also Proportional Integral Derivative PID controllers to manage overall the Fluid flow out 977 rate based on the Fluid flow in 970 to the system. Desired liquid levels values are established with Set Points SP 971 with actual Liquid Level Process Variables PV 972 and Pressure Sensors Process Variables PV 976 are compared by the PID controllers 974 monitoring the values and establishing an offset 973 or change that is translated to a Manipulated Variable MV 975 to adjust the Fluid Flow Output 977. The process is continuous with a preference in minimizing the need for constant adjustment by forecasting the rate of change in the processing algorithms. Multiple Process Variables PV, Set Points SP and Manipulated Variables MV are established for Process Control System 950 to monitor and control draft operations and product flow. Process Control System 950 uses a number of algorithms that interact with the PV's, SP's and MV's along with other parameters and heuristic based tables to control operation of Floating Platform 100.

As an example, a forward looking cascade of Proportional Integral PI to Proportional Integral Derivative PID gain scheduling algorithms for non-linear flows might be used. It would be noted by those experienced in the art that the example illustrated is extensively interrelated and is concomitant in operation with the gaseous control and buoyancy control portion of the Process Control System 950.

FIG. 14 illustrates a 4 phase solid, liquid and gas model of the Floating Platform 100 Rigid Enclosure 200, Self-Supporting Flexible Containment Enclosure (SSFCE) 500 and Bubble Diverting Assembly 240. The primary materials discussed are seawater, methane gas, methane hydrates and crude oil. Typically hydrocarbon emissions being both gaseous 566 and liquid 564 having a density less than Seawater 503 eventually rise to the surface and are constrained within the uppermost portion of the SSFCE 500 structure connected to Floating Platform 100 Rigid Enclosure 200. An enclosed and controlled volume of Gaseous product 566 prevents Liquid product 564 from rising within the Floating Platform 100 Rigid Enclosure 200 above a predetermined level such as the Waterline 502 used as a reference in this example. As more Liquid Product 564 is accumulated an increasing buoyant upward pressure is created and forces the Liquid product 564 through the upwardly ascending conduit to the Liquid Product Port 124 by the adjustment of a flow control valve (not shown) to release the Liquid Product 564. The gaseous product 566 bubbles ascend through the Seawater 503 and through the accumulated volume of Liquid product 564 contained within the uppermost portion of the SSFCE 500 structure and are deflected and diverted past the opening of the Liquid Product ascending conduit connected within the Bubble Diverting Assembly 240 lower portion. The Gaseous Product 566 bubbles continue their upward ascent and break through the upper surface of the accumulated Liquid Product 564 and continue to add to the maintained volume of Gas Product 566 that is released by the adjustment of flow control valve assembly 120 (not shown). When sufficient volumes have been established, the same inflow rate entering from the bottom of the SSFCE 500 will be removed from the SSFCE 500 enclosures uppermost section and Floating Platform 100 Rigid Enclosure 200 for both the Liquid product 564 and the Gaseous product 566 using adjustments of the flow control valve assemblies 120.

The inherent function of the upper portion of the SSFCE 500 structure and the Floating Platform 100 Rigid enclosure provides for the accumulation of Liquid product 564 by creating a vertical Gun barrel separation method that is well known, and eventually aggregating like type materials by natural phase separation using the Seawater 503 as the transport medium. Hydrocarbon emissions may be found as heated deposits located by deep well drilling in the earths crust. The release of these heated deposits from a well bore or fissure can generate a large amount of thermal energy. Additionally these thermal emissions when released eventually create a thermosyphon effect and may be compared to a contemporary residential wall radiator heating system in this example and model.

Ascending material at an elevated temperature 570 and transitioning to a Lower temperature 572 from the compromised emission site will typically move upward within the center of the SSFCE while Cooler Seawater Descending 574 will flow downward along the interior perimeter. The thermal flows expected are also likened to that of a chimney and a convection cycle is initiated. The natural dynamics of convection flow loops known as thermosyphons circulate the liquid by the changes in the buoyant forces generated by the thermal gradients due to heat introduced into the system, thermal loss due to conduction and dilution. The exterior of the SSFCE 500 also provides a substantial heat sink for increasing thermal dissipation due to conduction.

Pressure points 576, 577 and 578 are noted to indicate the relative gauge pressure is equal on both the interior and exterior surface and this equality is maintained irrespective of the depth.

In addition to normal occurring gaseous hydrocarbon emissions or Methane Gas 566 underground, there may be large deposits of Methane clathrates, typically called Methane hydrates 567 being a solid form of a large amount of methane trapped within a crystal structure of water forming a solid, very much like ice that can be found in underground reservoirs and even occur on the seafloor and on land at the appropriate temperature and pressures.

Methane hydrates 567 are often cited as problematic due to disruptions of oil and gas exploration and production operations in the obstructing or clogging of production lines or by the "kick" produced by the rapid sublimation from a solid to the release of methane gas 566 and water in a closed system such as a riser pipe section or from a well bore. Control to minimize or prevent these "kicks" is often accomplished by operations such as adjusting flow rates, the removal of water and the introduction of material like ethylene glycol or methanol, etc. Gaseous Hydrocarbon Emissions or Methane Gas 566 released from reservoirs and introduced into well bores and distribution lines may encounter lower temperatures and with high pressures may create the methane hydrates 567. Additionally Methane hydrate bearing layers are sometimes formed within geological formations pressurized by the weight of the formation pressure and seawater.

A depressurization inside the well enables the methane hydrates to dissociate into methane gas and water. When solid methane material 567 is introduced into the SSFCE 500 it finds a significant boundary barrier enclosed volume, a relaxed pressure and elevated temperature to undergo a natural gas phase transition while providing the room for the significant volumetric expansion to a gas without the need for hydrate inhibiting solvents to be used.

Containment and presentation operations are based on a "Ocean within an ocean" model providing an effective boundary barrier to the environment.

FIG. 15 illustrates communication pathway options.

Although the Floating Platform 100 and Floating Flare 800 structures Process Control Systems 950 and 850 respectively may be operated autonomously and even communicate between each other using a hard-wired communication path, a design capability embodiment is incorporated providing wireless communication between the Floating Platform 100 and the Floating Flare 800 to further ensure appropriate functions are performed. This is further enhanced by enabling remote monitoring and operations by the Local Site Deployment Operators 982 via a ground radio data link 980 while communication is conducted concurrently between Floating Platform 100 and Floating Flare 800 using the same ground radio data link 980.

If Local Site Deployment Operators 982 are out of range using Ground Radio Data Link 980, a communication link may also be established using the Satellite Data Link 988 to communicate to the Floating Platform 100 via Satellite Network 990. Furthermore, teams of Remote Spill Management, Engineering and Regulators 984 may access the operations globally via Satellite Data Link 988 and or Internet Network 986 via Satellite Network 990 and subsequently monitor, control and communicate directly to the Floating Platform 100, Floating Flare 800 and communicate to the Local Site Deployment Operators 982. With secured digital communication radio links using redundant ground radio data links 980 along with Satellite data links 988 providing access to a system such as the Inmarsat Broadband Global Area Network BGAN satellite system 990, a Human Machine Interface HMI enables senior management, engineers, government regulators, on-site personnel and others to have near real-time access to data and specific user access to operational control functions. Digital communications enable authorized secure local and global interaction to a combined supervisory autonomous control system with the present invention.

While the exemplary preferred embodiments of the present invention are described herein with particularity, those skilled in the art will appreciate various changes, additions, and applications other than those specifically mentioned, which are within the spirit of this invention. For example, certain components of SSFCE 500 may also be used to collect or transport other liquids or gases, such as pumped or sumped products from subway and tunnel flooding, or hydrocarbon emissions collected from marshes and estuaries or for the gross collection of hydrate saturated areas. SSFCE 500 components may also be used to divert water to fight fires.

What is claimed is:

1. Apparatus for collecting, separating, and delivering a combination of gaseous product and liquid product emitted into a liquid environment beneath the apparatus, the apparatus comprising:

a self-supporting flexible containment enclosure (SSFCE) forming a tube having a lower end disposed at the source of the gaseous product and liquid product and an upper end; and including— segments formed as elongated tubes, and a loop material flap formed at one end of each segment, and a hook material flap formed at the other end of each segment wherein the hook material flap on a segment engages with the loop material flap on an adjacent segment, forming a continuous tube;

subsea buoys attached to the segments for creating neutral or near-neutral buoyancy, a separator for separating the gaseous product and liquid product, the separator including— a separator enclosure comprising a rigid enclosure attached to the upper end of the SSFCE, a liquid product conduit for delivering liquid product to a liquid product destination, a gaseous product conduit for delivering gaseous product to a gaseous product destination, and a concave diverter having a closed bottom and an opening at its top disposed within the separator enclosure for diverting gaseous product away from the liquid conduit; wherein the apparatus is constructed and arranged such that the gaseous product and liquid product enter the SSFCE lower end, rise within the SSFCE, and reach the SSFCE upper end and the diverter;

wherein the liquid product conduit includes a first end disposed within the diverter to collect the liquid product and a second end spaced apart from the separator enclosure to deliver the liquid product; and wherein the gaseous product conduit includes a first end spaced apart from and above the diverter and the liquid product conduit first end to collect the gaseous product and a second end spaced apart from the separator enclosure to deliver the gaseous product.

2. The apparatus of claim 1 further comprising a control mechanism for determining volume of at least one of either liquid product or gaseous product within the separator enclosure and for changing pressure within the separator enclosure based on the determined volume.

3. The apparatus of claim 1 wherein at least one of the hook flap or the loop flap is formed in an I shape and the other of the hook flap or the loop flap is formed in a V shape configured to engage both sides of the I shape.

4. The apparatus of claim 1 further comprising straps attached along the long sides of segments wherein the straps include connection points configured to allow a strap end to connect to the end of an adjacent strap, wherein the connected straps provide structural support for the SSFCE.

5. The apparatus of claim 1 wherein an SSFCE segment further comprises a relief port having an opening configured to allow removal of a portion of SSFCE content.

6. The apparatus of claim 1 wherein an SSFCE segment forms a Y shape such that one end of the Y allows for a single gaseous product and liquid product flow and the other end of the Y allows for two gaseous product and liquid product flows.

7. The apparatus of claim 1 wherein the SSFCE further comprises a terminator interface assembly configured to engage a targeted area of emissions.

8. The apparatus of claim 7 wherein the terminator assembly comprises a flaring canopy having a clamping mechanism for clamping the canopy to an underwater surface.

9. The apparatus of claim 7 wherein the terminator assembly comprises a conduit and apparatus for engaging the conduit to an opening.

10. The apparatus of claim 1 wherein the gaseous product destination further comprises a flare platform configured to burn off gaseous product.

11. The apparatus of claim 1 further including a floating platform attached to the separator enclosure, the floating platform further including apparatus configured to selectively change platform buoyancy to change draft of the floating platform.

12. A method of collecting, separating, and delivering a combination flow of gaseous product and liquid product emitted into a liquid environment, the method comprising the steps of:

(a) providing a tubular self supporting flexible containment enclosure (SSFCE) having a bottom end disposed at a source of the emitted product flow and a top end above the source of the emitted product flow including the steps of forming segments formed as elongated tubes;

forming a loop material flap at one end of each segment;

forming a hook material flap at the other end of each segment;

engaging the hook material flap on a segment with the loop material flap on an adjacent segment, forming a continuous tubular SSFCE;

attaching the bottom end of the SSFCE adjacent to the source of the emitted product flow;

partially filling the SSFCE with liquid from the liquid environment; and attaching the top end of the SSFCE to the separator;

(b) allowing the emitted product flow to rise within the SSFCE to a separator area;

(c) within the separator area, separating the gaseous product from the liquid product by diverting the gaseous product away from a diverter area, allowing the gaseous product to rise above the diverter area, and allowing the liquid product to sink into the diverter area;

(d) collecting the gaseous product above the diverter area and presenting the separated gaseous product to a gaseous product destination; and (e) collecting the separated liquid product from the diverter area and presenting the separated liquid product to a liquid product destination.

13. The method of claim 12 wherein the step of separating comprises the steps of:

(c1) introducing a closed concave diverter into the rising product flow, the closed side of the diverter disposed downward toward the emitted flow;

(c2) diverting the flow around the diverter;

(c3) allowing the liquid product to sink into the diverter upper open side; and (c4) allowing the gaseous product to rise above the diverter.

14. The method of claim 13 wherein the step of presenting the separated liquid product to a liquid product destination comprises the step of collecting the liquid product within the diverter upper open side and passing it through a liquid conduit to the liquid product destination; and wherein the step of presenting the separated gaseous product to a gaseous product destination comprises the step of collecting the gaseous product above the diverter and passing it through a gaseous conduit to the gaseous product destination.

15. The method of claim 12 further comprising the steps of:

determining volume of at least one of either liquid product or gaseous product within the separator enclosure; and changing pressure within the separator enclosure based on the determined volume.

16. The method of claim 12 further comprising the step of attaching subsea buoys to the segments and creating near-neutral buoyancy.

17. The method of claim 12 including the steps of forming at least one of the hook flap or the loop flap in an I shape and forming the other of the hook flap or the loop flap in a V shape configured to engage both sides of the I shape.

18. The method of claim 12 further comprising the steps of attaching straps along the long sides of segments, providing connection points at the end of the straps, and attaching adjacent straps to provide structural support for the SSFCE.

19. The method of claim 12 wherein the step of attaching the bottom end of the SSFCE adjacent to the source of the emitted product flow further comprises the step of providing a flaring canopy and clamping the canopy to an underwater surface.

20. The method of claim 12 wherein the step of attaching the bottom end of the SSFCE adjacent to the source of the emitted product flow further comprises the step of providing conduit and engaging the conduit to an opening.

21. The method of claim 12 further comprising the step of burning off gaseous product at the gaseous product destination.

22. The method of claim 12 further including the steps of providing a floating platform attached to the separator enclosure, and selectively changing the buoyancy of the platform to change the draft of the platform.

* * * * *